US007418933B2

(12) United States Patent
Mizorogi et al.

(10) Patent No.: US 7,418,933 B2
(45) Date of Patent: Sep. 2, 2008

(54) VARIABLE LIFT VALVE OPERATING SYSTEM FOR INTERNAL COMBUSTION ENGINE

(75) Inventors: Takahumi Mizorogi, Saitama (JP); Masayuki Toyokawa, Saitama (JP); Hidetaka Ozawa, Saitama (JP); Hiroyuki Murase, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/403,204

(22) Filed: Apr. 13, 2006

(65) Prior Publication Data

US 2006/0254544 A1 Nov. 16, 2006

(30) Foreign Application Priority Data

Apr. 27, 2005 (JP) ..... 2005-130092
Apr. 27, 2005 (JP) ..... 2005-130093
Apr. 27, 2005 (JP) ..... 2005-130094

(51) Int. Cl.
*F01L 1/34* (2006.01)

(52) U.S. Cl. ..... 123/90.16; 123/90.15; 123/90.31

(58) Field of Classification Search ..... 123/90.16, 123/90.17, 90.15, 90.31, 90.11
See application file for complete search history.

(56) References Cited

U.S. PATENT DOCUMENTS 5,065,720 A * 11/1991 Nishiyama et al. ..... 123/363
5,331,931 A * 7/1994 Blish et al. ..... 123/90.11
6,145,485 A 11/2000 Bidlingmaier et al. ... 123/90.16
6,553,952 B2 * 4/2003 Grau ..... 123/90.17
6,684,831 B2 * 2/2004 Grau ..... 123/90.16
2001/0050205 A1 * 12/2001 Goto et al. ..... 192/20
2002/0195071 A1 12/2002 Shimizu et al. ..... 123/90.16
2004/0031456 A1 2/2004 Nakamura et al. ..... 123/90.15
2004/0216707 A1 * 11/2004 Minami et al. ..... 123/90.16

FOREIGN PATENT DOCUMENTS

DE 195 17 547 2/1996
JP 2004115267 A * 4/2004
JP 2005-42642 2/2005

OTHER PUBLICATIONS

European Search Report mailed Sep. 12, 2006 (2 pages).
Patent Abstracts of Japan, vol. 2000, No. 11 and JP 2000 234507, UNISIA JECS. Corp.; NISSAN MOTOR Co. Ltd; Aug. 29, 2000.

* cited by examiner

*Primary Examiner*—Zelalem Eshete
(74) *Attorney, Agent, or Firm*—Kratz, Quintos & Hanson, LLP

(57) ABSTRACT

A variable lift valve operating system for an internal combustion engine, including a variable lift mechanism capable of changing a lift amount of an engine valve in accordance with rotation of a control shaft rotatably supported in a cylinder head, and an actuator which has an electric motor and power transmission means interposed between the electric motor and the control shaft, and which is connected to the control shaft. The actuator is constructed to have an oilless structure without oil supply, thereby always stably and rotationally driving the control shaft.

11 Claims, 18 Drawing Sheets

VARIABLE LIFT VALVE OPERATING SYSTEM FOR INTERNAL COMBUSTION ENGINE

RELATED APPLICATION DATA

The Japanese priority application Nos. 2005-130092, 2005-130093 and 2005-130094 upon which the present application is based are hereby incorporated in their entirety herein by reference.

BACKGROUND OF THE INVENTION

1. Field of the Invention

The present invention relates to a variable lift valve operating system for an internal combustion engine, including: a variable lift mechanism which has a control shaft rotatably supported in a cylinder head, and which is capable of changing a lift amount of an engine valve in accordance with rotation of the control shaft; and an actuator which has an electric motor and power transmission means that is interposed between the electric motor and the control shaft, and which is connected to the control shaft.

2. Description of the Related Art

Japanese Patent Application Laid-open No. 2005-42642 discloses a valve operating system in which one end portion of a lever is fixed to a control shaft, and the control shaft is rotated by sliding a nut connected to the other end portion of the lever by the rotating operation of a screw shaft on which the nut is screwed, whereby the lift amount of an intake valve is changed.

In such a variable lift valve operating system, when an actuator has a structure which lubricates, with oil, power transmission means interposed between the electric motor and the control shaft, friction in the power transmission means changes due to change in oil viscosity depending on the ambient temperature, and therefore, it is difficult to rotationally drive the control shaft stably at all times.

SUMMARY OF THE INVENTION

The present invention has been achieved in view of the above circumstances, and has an object to provide a variable lift valve operating system for an internal combustion engine capable of rotationally driving a control shaft stably at all times.

In order to achieve the above object, according to a first feature of the present invention, there is provided a variable lift valve operating system for an internal combustion engine, comprising: a variable lift mechanism which has a control shaft rotatably supported in a cylinder head, and which is capable of changing a lift amount of an engine valve in accordance with rotation of the control shaft; and an actuator which has an electric motor and power transmission means that is interposed between the electric motor and the control shaft, and which is connected to the control shaft, wherein the actuator is constructed to have an oilless structure without oil supply.

With this arrangement, the actuator is constructed to have an oilless structure without oil supply, whereby a change in friction is not caused even if the ambient temperature changes, and the control shaft can be always stably and rotationally driven. Because an oil seal is not required, the driving efficiency of the electric motor is improved, and the default operation at a time of fail-safe becomes smooth.

According to a second feature of the present invention, in addition to the first feature, at least one of gears which constitute a part of the actuator and which are in a pair to be meshed with each other is formed of a synthetic resin.

With this arrangement, at least one of the pair of gears meshed with each other is formed of a synthetic resin, whereby durability and quietness can be secured while enabling the oilless structure.

According to a third feature of the present invention, in addition to the first or second feature, a casing of the actuator and the cylinder head are fitted to each other; and the casing is fastened to the cylinder head at four spots on a periphery of the electric motor.

With this arrangement, the casing of the actuator and the cylinder head are fitted to each other, whereby the positioning accuracy of the casing with respect to the cylinder head is improved. Further, the periphery of the electric motor which is a vibration generating source in the actuator is fixed to the cylinder head, whereby the vibration exerted from the cylinder head side to the actuator side can be suppressed, and the vibration caused by the operation of the electric motor can be suppressed, so that durability and quietness can be further improved.

The above-mentioned object, other objects, characteristics, and advantages of the present invention will become apparent from preferred embodiments, which will be described in detail below by reference to the attached drawings.

BRIEF DESCRIPTION OF THE DRAWINGS

FIG. 1 is a side view of an internal combustion engine in a state in which the internal combustion engine is mounted on a vehicle.

FIG. 2 is a view seen in the arrow 2 in FIG. 1.

FIG. 3 is a vertical sectional side view of an intake side valve operating system according to the first embodiment of the present invention.

FIG. 4 is an exploded perspective view of the intake side valve operating system.

FIG. 5 is a side view of an actuator.

FIG. 6 is a vertical sectional side view showing the actuator by cutting away an upper portion.

FIG. 7 is a sectional view taken on the line 7-7 in FIG. 6.

FIG. 8 is a schematic diagram for explaining a construction of a default mechanism.

FIG. 9 is a side view of an internal combustion engine in a state in which the internal combustion engine is mounted on a vehicle.

FIG. 10 is a view seen in the arrow 10 in FIG. 9.

FIG. 11 is a view seen in the arrow 11 in FIG. 9.

FIG. 12 is a plane view of an actuator.

FIG. 13 is a view seen in the arrow 13 in FIG. 12.

FIG. 14 is a sectional view taken on line 14-14 in FIG. 12.

FIG. 15 is a sectional view taken on line 15-15 in FIG. 12.

FIG. 16 is a front view of a jig.

FIG. 17 is a view seen in the arrow 17 in FIG. 16.

FIG. 18 is a vertically sectional side view showing an operation state of fixing a worm wheel to a control shaft by using the jig.

DESCRIPTION OF THE PREFERRED EMBODIMENTS

Figure 1:
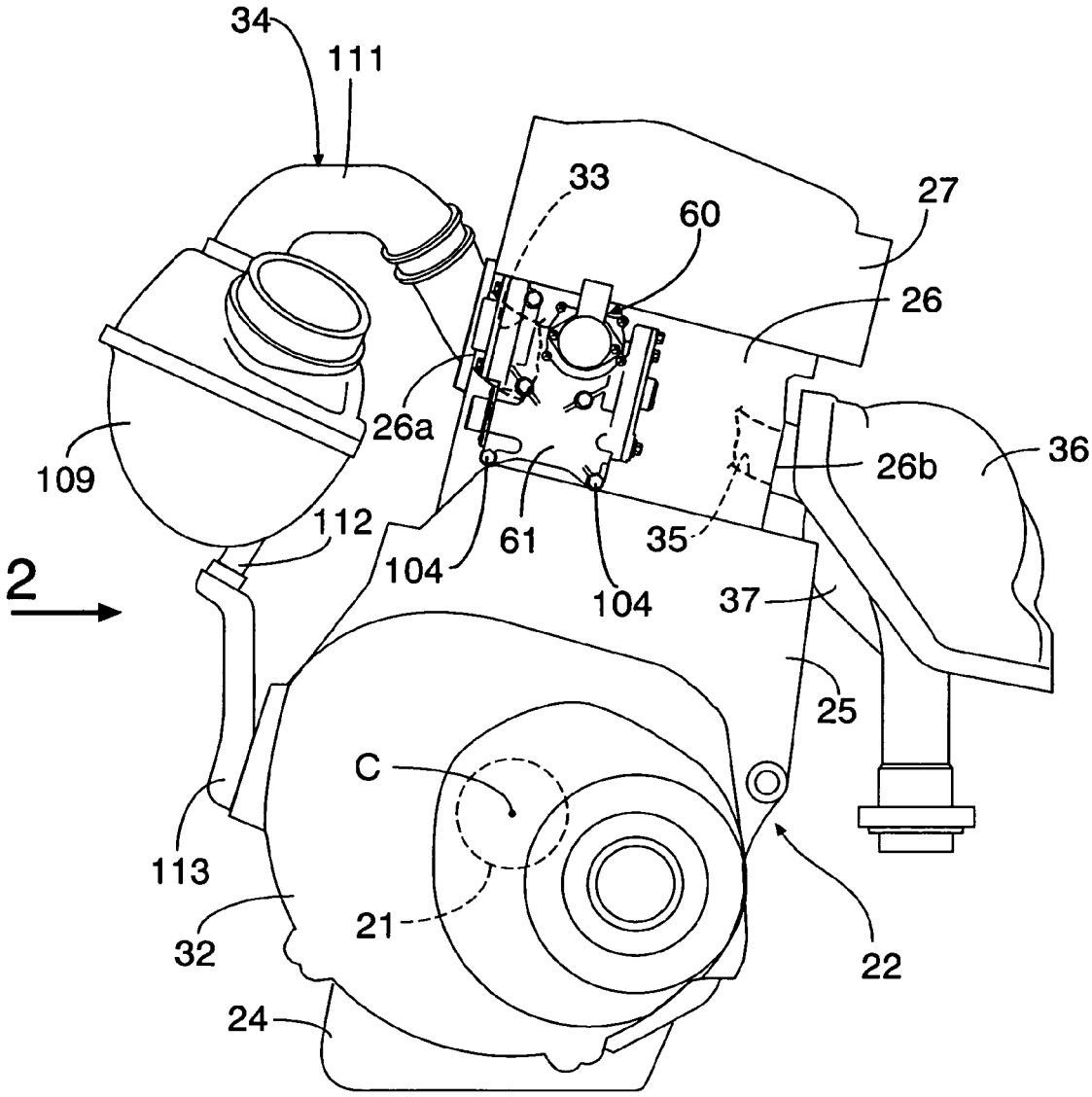
FIGS. 1 to 8 show a first embodiment of the present invention.
Figure 2:
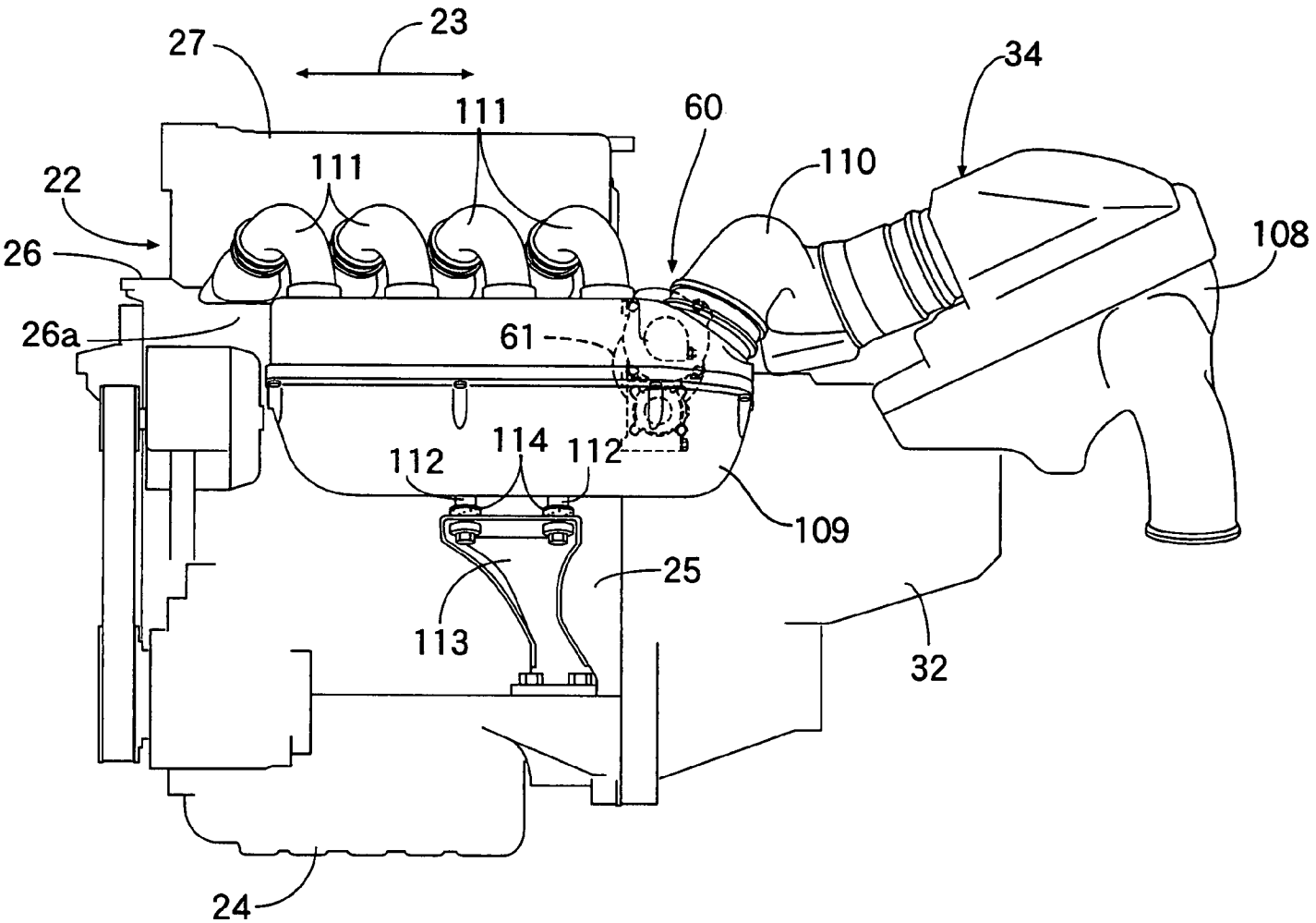

Describing a first embodiment of the present invention with reference to FIGS. 1 to 8, a multiple-cylinder, for example, four-cylinder engine body 22 with an axis C of a crankshaft 21 extending along a width direction of a vehicle is mounted on a front part of the vehicle. Cylinders are provided in the engine body 22, side by side in a cylinder arranging direction 23 parallel with the axis C.

The engine body 22 includes a crankcase 24 that rotatably supports the crankshaft 21, a cylinder block 25 connected to the crankcase 24, a cylinder head 26 connected to the cylinder block 25, and a head cover 27 connected to the cylinder head 26. A transmission case 32 housing a transmission is connected to a left end of the crankcase 24 in a state facing forward in a traveling direction of the vehicle so as to form a space on a left side of the engine body 22 and above the transmission case 32.

Intake ports 33 for the respective cylinders are provided at one side wall 26*a* (see FIG. 1) facing a front side of the cylinder head 26, and an intake system 34 is connected to the intake ports 33. Exhaust ports 35 for the respective cylinders are provided at the other side wall 26*b* (see FIG. 1) facing a rear side of the cylinder head 26, and an exhaust manifold 37 covered with a heat shield cover 36 from above is connected to the exhaust ports 35.

The intake system 34 includes an air cleaner 108, an intake chamber 109 disposed forward of the cylinder head 26 in common for the respective cylinders, a pipeline member 110 such as a hose which connects together the air cleaner 108 and the intake chamber 109, and a plurality of intake pipes 111 that are separated for the respective cylinders from the intake chamber 109 and are connected to the cylinder head 26. A pair of support legs 112 and 112 are provided at the intake chamber 109 to extend downward, and these support legs 112 are supported at a bracket 113 which is mounted on the crankcase 24 via elastic members 14.

Figure 3:
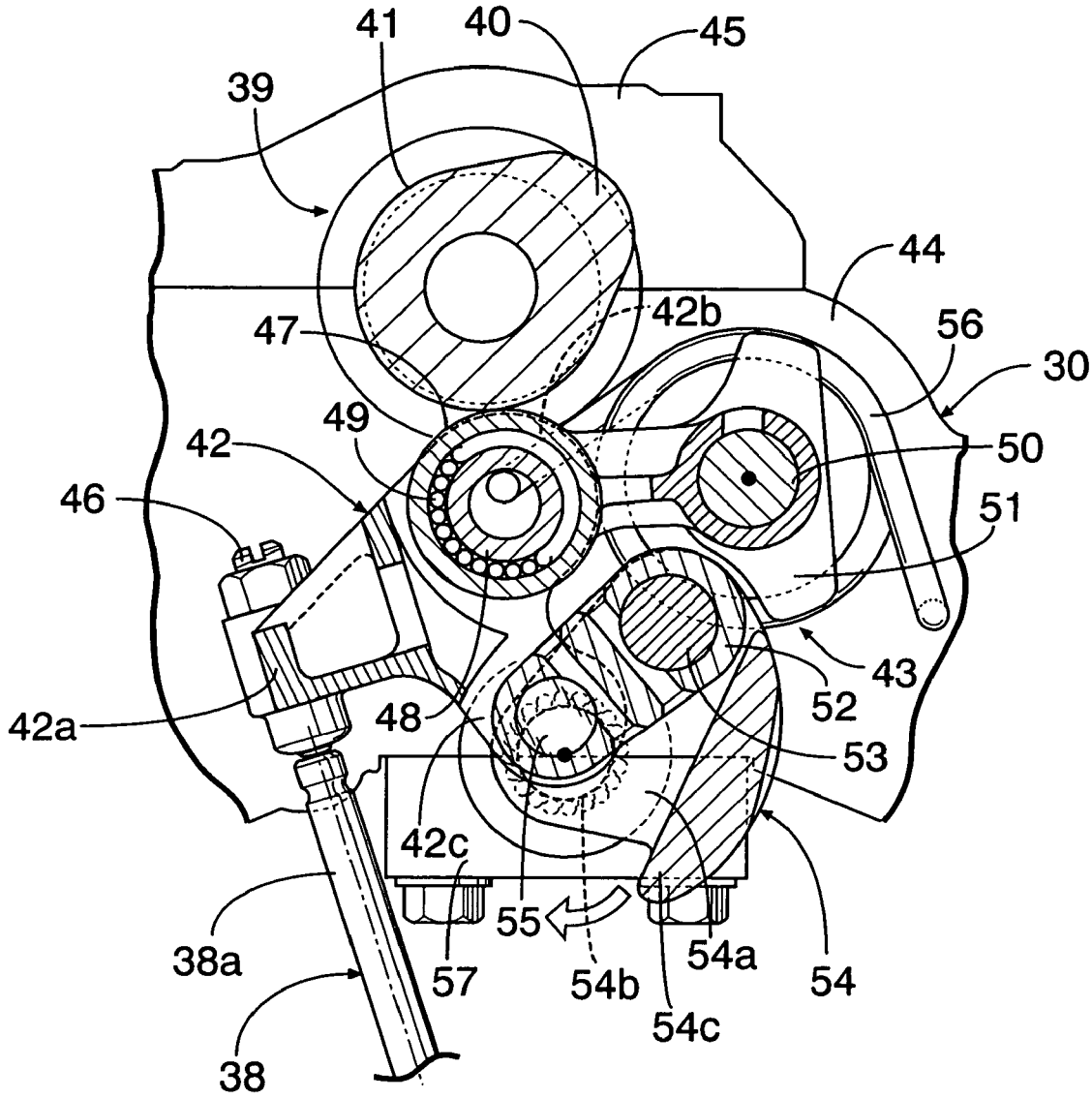
Figure 4:
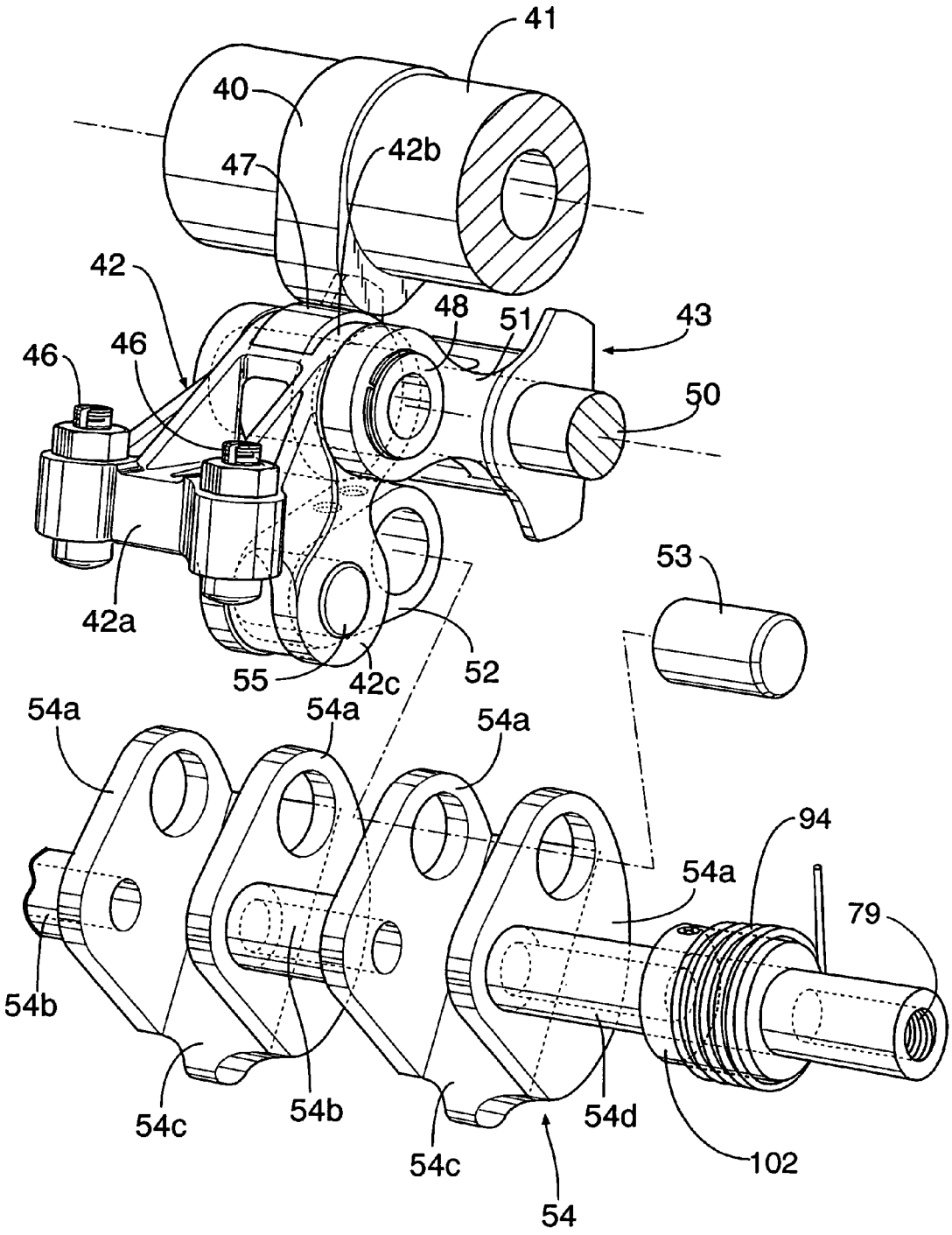

In FIGS. 3 and 4, in the cylinder head 26, intake valves 38 which are a pair of engine valves are disposed for each of the intake ports 33 to be capable of opening and closing operation, and an intake side valve operating system 39 that drives each of the intake valves 38 to open and close includes an intake side camshaft 41 having an intake side valve operating cam 40 for each cylinder, an intake side rocker arm 42 that swings following the intake side valve operating cam 40, and is operated and connected in common with a pair of intake valves 38 for each cylinder, and a variable lift mechanism 43 that continuously changes a valve opening lift amount among the operating characteristics of the intake valves 38.

Upper holders 44 are fastened to the cylinder head 26 to be disposed at opposite sides of each of the cylinders. Caps 45 rotatably supporting the intake side camshaft 41 in cooperation with each of the upper holders 44 are fastened to top surfaces of the upper holders 44.

A valve connecting part 42*a,* into which tappet screws 46 abutting from above on upper ends of stems 38*a* in a pair of intake valves 38 are screwed so that their advance and retreat positions are adjustable, is provided at one end portion of the intake side rocker arm 42. A first support part 42*b* and a second support part 42*c* which is disposed below the first support part 42*b* are provided at the other end portion of the intake side rocker arm 42 to connect to each other. The first and second support parts 42*b* and 42*c* are each formed into a substantially U shape which opens on a side opposite from the intake valves 38.

A roller 47 in rolling contact with the intake side valve operating cam 40 of the intake side camshaft 41 is supported on the first support part 42*b* of the intake side rocker arm 42 via a first connecting shaft 48 and a needle bearing 49. The roller 47 is disposed to be caught in the first support part 42*b* having a substantially U shape.

The variable lift mechanism 43 includes a first link arm 51 which has one end portion rotatably connected to the first support part 42*b* of the intake side rocker arm 42 and the other end portion rotatably supported at a fixed support shaft 50, a second link arm 52 which has one end portion rotatably connected to the second support part 42*c* of the intake side rocker arm 42 and the other end portion rotatably supported,at a movable support shaft 53, and a control shaft 54 which is connected to the movable support shaft 53 to be capable of angularly displacing the movable support shaft 53 around an axis that is parallel with the axis of the movable support shaft 53.

The one end portion of the first link arm 51 is formed into a substantially U-shape to catch the first support part 42*b* of the intake side rocker arm 42 from opposite sides, and is rotatably connected to the first support part 42*b* via the first connecting shaft 48 supporting the roller 47 at the intake side rocker arm 42. The fixed support shaft 50 rotatably supporting the other end portion of the first link arm 51 is supported by the upper holder 44.

The one end portion of the second link arm 52 disposed below the first link arm 51 is disposed to be caught in the second support part 42*c* of the intake side rocker arm 42, and is rotatably connected to the second support part 42*c* via a second connecting shaft 55.

Both the intake valves 38 are biased in a valve closing direction by a valve spring (not shown). When both the intake valves 38 which are biased in the valve closing direction by the spring are driven in a valve opening direction by the intake side rocker arm 42, the roller 47 of the intake side rocker arm 42 is in contact with the intake side valve opening cam 40 due to the biasing force of the valve spring. However, in the valve closing state of the intake valves 38, the biasing force of the valve spring does not act on the intake side rocker arm 42, and the roller 47 separates from the intake side valve operating cam 40, leading to a possibility of reducing the control accuracy of the valve lift amount at the time of very slightly opening the intake valves 38. Therefore, the intake side rocker arm 42 is biased in a direction to cause the roller 47 to abut on the intake side valve operating cam 40 by a rocker arm biasing spring 56 which is a member separate from the valve spring.

The control shaft 54 is a single member in common use for a plurality of cylinders arranged in a line, and is constructed into an integral crank shape having, for each cylinder, webs 54*a* which are disposed at opposite sides of the intake side rocker arm 42, shaft parts 54*b* which perpendicularly connect to outer surfaces of base end portions of both the webs 54*a,* and connecting parts 54*c* which connect both the webs 54*a*. The movable support shaft 53 having the axis parallel with the fixed support shaft 50 and the shaft parts 54*b* is connected to the control shaft 54 to connect together both the webs 54*a*. The shaft parts 54*b* are rotatably supported by the upper holders 44 and lower holders 57 which are fastened to lower surfaces of the respective upper holders 44.

The second connecting shaft 55 which connects the second link arm 52 to the intake side rocker arm 42 when the intake valves 38 are in the valve closing state, is on the same axis as the shaft parts 54*b* of the control shaft 54. When the control shaft 54 swings around the axis of the shaft parts 54*b,* the movable support shaft 53 moves on an arc with the axis of the shaft parts 54*b* as a center.

When the control shaft 54 rotates in the direction in which the movable support shaft 53 descends, and the roller 47 is pressed by the intake side valve operating cam 40 of the intake side camshaft 41, a four-joint link which connects together the fixed support shaft 50, the first connecting shaft 48, the second connecting shaft 55 and the movable support shaft 53, deforms to swing the intake side rocker arm 42 downward, and the tappet springs 46 press the stems 38*a* of the intake valves 38 to open the intake valves 38 with low lift.

When the control shaft 54 rotates in a direction in which the movable support shaft 53 ascends, and the roller 47 is pressed with the intake side valve operating cam 40 of the intake side camshaft 41, the four-joint link deforms to swing the intake side rocker arm 42 downward, and the tappet screws 46 press the stems 38*a* of the intake valves 38 to open the intake valves 38 with high lift.

The one end portion of the control shaft 54 along the cylinder arranging direction 23, namely, a shaft part at the one end side along the cylinder arranging direction 23 among a plurality of shaft parts 54*b* of the control shaft 54 is formed to be relatively long as a connecting shaft part 54*d*. The connecting shaft part 54*d* protrudes to the left side of the cylinder head 26, and into a casing 67 of an actuator 60 which is mounted to the outer surface of the end wall of the left side of the cylinder head 26.

Figure 5:
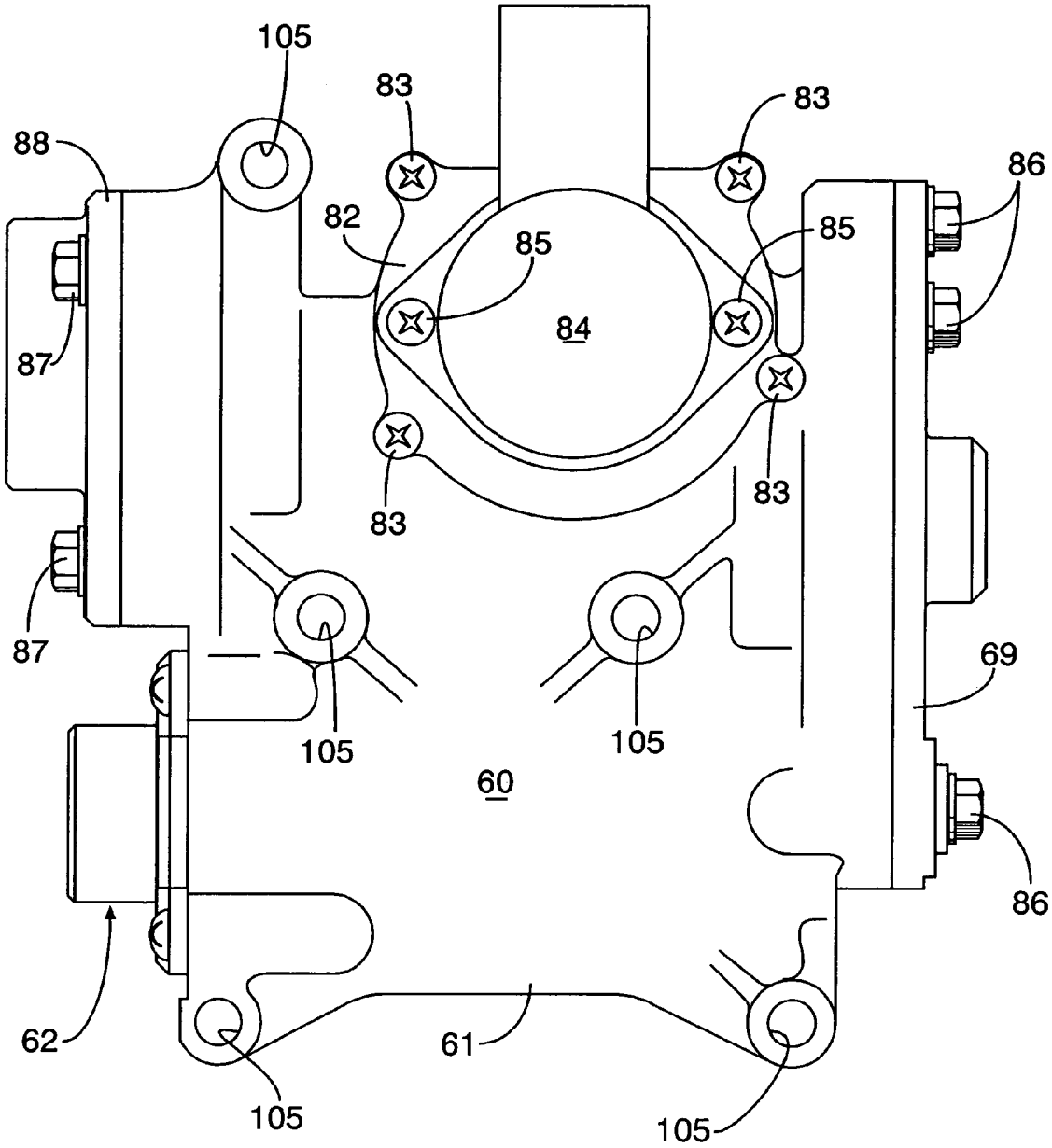
Figure 6:
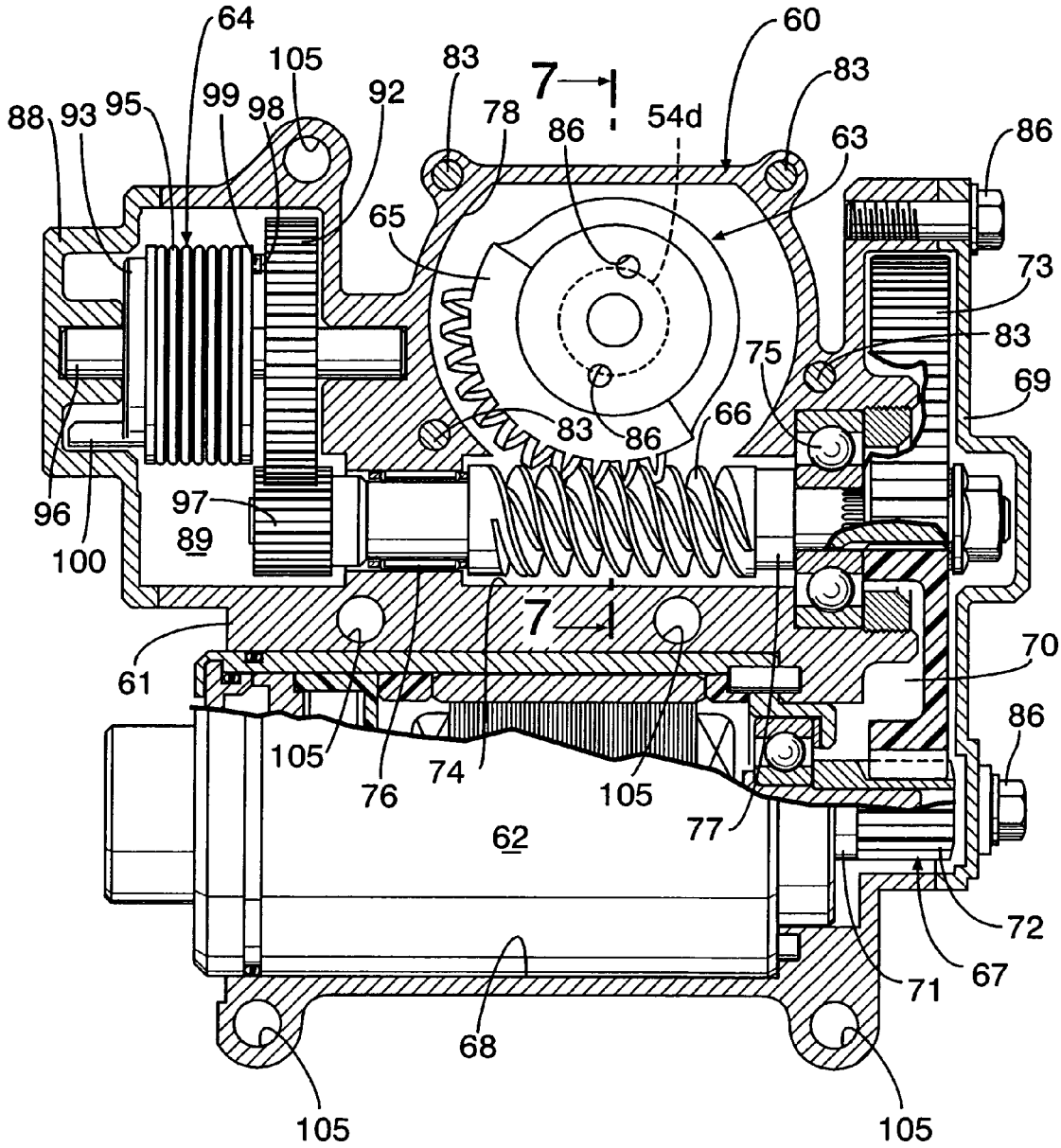
Figure 7:
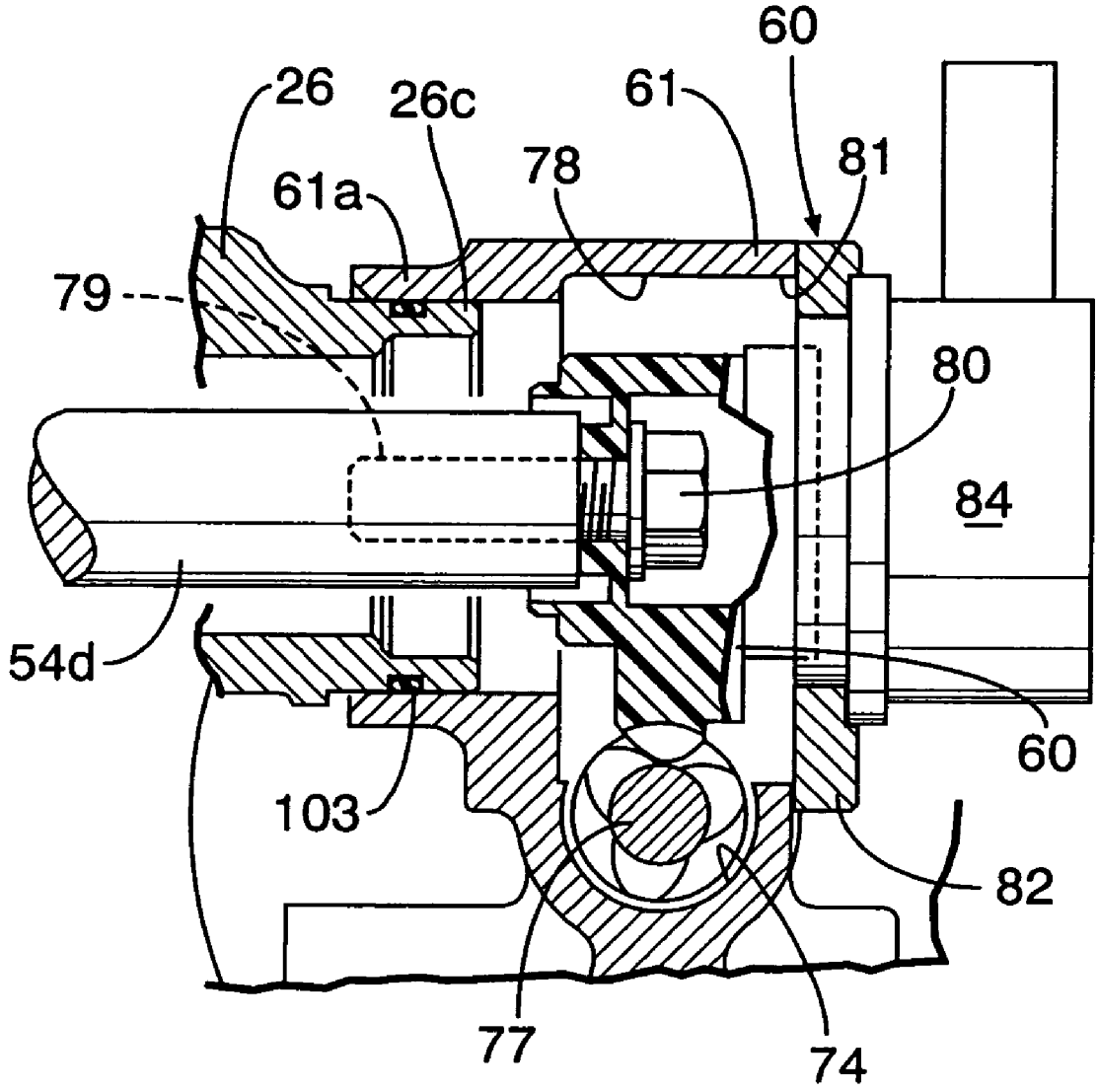

In FIGS. 5 to 7, the actuator 60 includes an electric motor 62, power transmission means 63 which is provided between the electric motor 62 and the connecting shaft part 54*d* of the control shaft 54, a default mechanism 64 for maintaining the connecting shaft part 54*d*, namely, the control shaft 54 in a predetermined rotational position when the electric motor 62 is not energized, and a casing 61 having an oilless structure without oil supply and accommodating these members 62, 63 and 64.

The power transmission means 63 is constructed to rotationally drive the control shaft 54 to change the lift amount of the intake valves 38 in accordance with the operation of the electric motor 62 forwardly and reversely rotatable with the default position by the default mechanism 64 as a zero position, and is connected to the connecting shaft part 54*d* of the control shaft 54; and includes a worm wheel 65 fixed to the connecting shaft part 54*d*, a worm gear 66 which is meshed with the worm wheel 65, and a deceleration mechanism 67 provided between the worm gear 66 and the electric motor 62.

A motor accommodation hole 68 circular in cross-section is provided in a lower portion of the casing 61 so as to extend in the longitudinal direction at the time of the engine body 22 being mounted on the vehicle, and the electric motor 62 is fitted in and fixed to the motor accommodation hole 68. A first cover 69 is fastened by a plurality of bolts 86 to one side wall of the casing 61 which becomes a rear side wall at the time of the engine body 22 being mounted on the vehicle. The deceleration mechanism 67 comprising a driving gear 72 provided at an output shaft 71 of the electric motor 62 and a driven gear 73 which is meshed with the driving gear 72 is accommodated in a deceleration mechanism accommodation chamber 70 formed between the casing 61 and the first cover 69.

The worm gear 66 is accommodated in a worm gear accommodation hole 74 provided parallel with the motor accommodation hole 68 above the motor accommodation hole 68, and is provided on an outer periphery of a worm gear shaft 77 whose one end portion is rotatably supported at the casing 61 via a ball bearing 75 while the other end portion is rotatably supported at the casing 61 via a needle bearing 76. Thus, one end of the worm gear shaft 77 protrudes into the deceleration mechanism accommodation chamber 70, and the driven gear 73 is provided at the one end of the worm gear shaft 77.

A worm wheel accommodation chamber 78 which leads to an intermediate portion of the worm gear accommodation hole 74 is formed in the upper portion of the casing 61, and accommodates therein the worm wheel 65. Thus, the connecting shaft part 54*d* of the control shaft 54 protrudes into the worm wheel accommodation chamber 78, and the worm wheel 65 is fastened and fixed to the connecting shaft part 54*d* with a bolt 80 which is screwed into a screw hole 79 (see FIGS. 4 and 7) coaxially provided in an end portion of the connecting shaft part 54*d*.

An opening 80 is provided in an upper portion of the casing 61 on a side opposite from the cylinder head 26, and a lid member 82 which blocks the opening 80 is fastened to the casing 61 with a plurality of screw members 83. A position sensor 84 opposed to the worm wheel 65 is mounted to the lid member 82 with a plurality of screw members 85, and a pair of detection holes 86 and 86 in which the position sensor 84 is engaged are provided in the worm wheel 65.

A second cover 88 is fastened by a plurality of bolts 87 to the other side wall of the casing 61 at the side opposite from the deceleration mechanism accommodation chamber 70 with respect to the worm wheel accommodation chamber 78, and a default mechanism accommodation chamber 89 accommodating a main part of the default mechanism 64 is formed between the casing 61 and the second cover 88.

The default mechanism 64 includes a large diameter gear 92 which is moved with and connected to the electric motor 62, a spring holder 93 capable of rotating around the same axis of the large diameter gear 92, a first default spring 94 (see FIG. 4) which biases the large diameter gear 92 in a direction to abut on and engage with the spring holder 93, and a second default spring 95 which biases the spring holder 93 in the reverse direction from the first default spring 94 in the abutting and engaging state of the large diameter gear 92 to and with the spring holder 93.

The large diameter gear 92 is rotatably supported at opposite ends by a default shaft 96 which has an axis parallel with the worm gear shaft 77 and which is supported at the casing 61 and the second cover 88, and is meshed with a small diameter gear 97 provided at the other end portion of the worm gear shaft 77. Thus, the large diameter gear 92 is moved with and connected to the electric motor 62 via the small diameter gear 97, the worm gear shaft 77 and the deceleration mechanism 67, so that the large diameter gear 92 rotates in the rotational range of less than one rotation in accordance with the electric motor 62 rotating within the operation range in which the lift amount of the intake valves 38 is changed from the maximum lift amount to the minimum lift amount, for example, to complete closing. Namely, the large diameter gear 92 is moved with and connected to the electric motor 62 to rotate in the rotational range of less than one rotation in accordance with the rotation of the electric motor 62 within the range of the change in lift amount of the intake valves 38.

The spring holder 93 is supported on the default shaft 96 to be rotatable relatively to the large diameter gear 92. Engaging protrusions 98 and 99 which abut to and engage with each other corresponding to the rotation of the large diameter gear 92 which changes the lift amount of the intake valves 38 between a predetermined lift amount and the minimum lift amount are respectively projectingly provided on opposing surfaces of the large diameter gear 92 and the spring holder 93. When the large diameter gear 92 rotates to change the lift amount of the intake valves 38 between the predetermined lift amount and the minimum lift amount, the spring holder 93 rotates around the same axis of the large diameter gear 92. A restricting protrusion 100 projectingly provided at the spring holder 93 abuts on a stopper 101 (see FIG. 8) which is provided at the second cover 88 in accordance with the rotation of the spring holder 93 when the lift mount of the intake valves 38 is changed from the minimum lift amount to the predetermined lift amount, thereby restricting the rotation of the spring holder 93. The rotational range of the spring holder 93 is restricted to between the predetermined lift amount and the minimum lift amount.

The second default spring 95 is a helical torsion coil spring wound around the spring holder 93, and its one end is engaged with the spring holder 93 while the other end is engaged with the casing 61. Thus, the second default spring 95 exerts a spring force for biasing the spring holder 93 from the minimum lift amount side to the predetermined lift amount side, and its spring load is set to be larger than that of the first default spring 94. It is possible to use a spiral spring instead of the helical torsion coil spring as the second default spring 95.

Paying attention to FIG. 4, a cylindrical spring holder 102 surrounding the connecting shaft part 54*d* is fixed to the connecting shaft part 54*d* of the control shaft 54 inside the cylinder head 26, and the first default spring 94 that is a helical torsion coil spring is wound around the spring holder 102. One end of the first default spring 94 is engaged with the cylinder head 26, and the other end of the first default spring 94 is engaged with the spring holder 102.

Namely, the first default spring 94 has not only the function of biasing the large diameter gear 92 in the direction to abut on and engage with the spring holder 93, but also the function of absorbing backlash between the worm wheel 65 and the worm gear 66, and is interposed between the connecting shaft part 54*d* of the control shaft 54 and the cylinder head 26.

In this manner, among the large diameter gear 92, the spring holder 93, the first default spring 94 and the second default spring 95 which construct the default mechanism 64, the main part except for the first default spring 94, namely, the large diameter gear 92, the spring holder 93 and the second default spring 95 are accommodated in the default mechanism accommodation chamber 89 of the actuator 60, and only the first default spring 94 is placed in the cylinder head 26.

Figure 8:
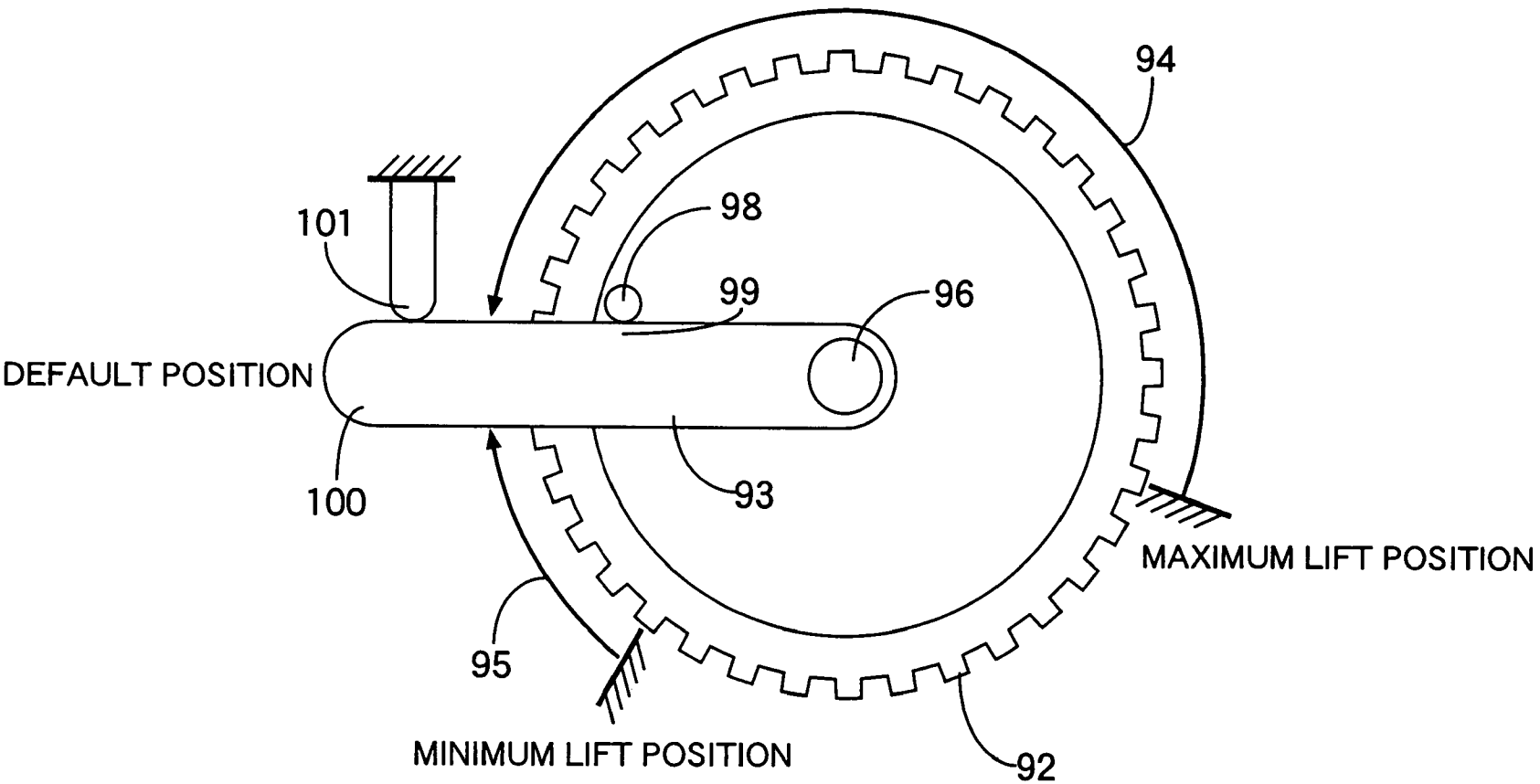

Describing the operation of the default mechanism 64 by referring to FIG. 8 schematically showing the construction of the default mechanism 64, the large diameter gear 92 is biased from the maximum lift position by the first default spring 94 to the minimum lift position side, and the spring holder 93 which has the rotational range restricted to the range from the minimum lift position to the default position that is the predetermined lift amount of the intake valves 38 is biased from the minimum lift position to the default position side by the second default spring 95 which has larger spring load than the first default spring 94. Accordingly, in the non-energized state of the electric motor 62, the large diameter gear 92 is biased by the first default spring 94 to rotate to the position where the engaging protrusion 98 is caused to abut on and engage with the engaging protrusion 93 of the spring holder 93; the spring holder 93 is rotated by the second default spring 95 to the default position; and also the large diameter gear 98 which is moved with and connected to the control shaft 54 via the small diameter gear 94, the worm gear shaft 77, the worm gear 66 and the worm wheel 65 is in the default position, whereby the lift amount of the intake valves 38 is kept at the predetermined amount.

Incidentally, at least one of the gears which construct a part of the actuator 60 and in pairs to be meshed with each other, namely, at least one of the worm wheel 65 and the worm gear 66, one of the driving gear 72 and the driven gear 73, and one of the large diameter gear 92 and the small diameter gear 97 are formed of a synthetic resin, and in this embodiment, the worm wheel 65, the driven gear 73 and the large diameter gear 92 are formed of a synthetic resin such as, for example, nylon and PEEK (trade name of Victrex plc.).

As clearly shown in FIG. 7, a cylindrical barrel part 61*a* leading to the worm wheel accommodation chamber 78 is provided in the casing 61; a cylindrical barrel part 26*c* which coaxially surrounds the connecting shaft part 54*d* of the control shaft 54 is provided at a left end wall of the cylinder head 26 to be fittable to the barrel part 61*a;* and an O-ring 103 which elastically contacts an inner periphery of the barrel part 61*a* is fitted to an outer periphery of the barrel part 26*c*. Namely, the casing 61 and the cylinder head 26 are fitted to each other in the direction along the axis of the connecting shaft part 54*d* of the control shaft 54.

The casing 61 of the actuator 60 is mounted to the cylinder head 26 with a plurality of bolts 104 (see FIG. 1). Four insertion holes 105 through which the bolts 104 are inserted are provided in the casing 61 at four spots of a periphery of the electric motor 62 which is fitted and fixed into the motor accommodation hole 68. The insertion hole 105 is provided in the casing 61 above the default mechanism accommodation chamber 89.

Namely, the casing 61 is fastened to the cylinder head 26 at the four spots of the periphery of the electric motor 62, and the upper portion of the casing 61 is fastened to the cylinder head 26 at the one spot.

Next, describing an operation of the first embodiment, the control shaft 54 of the variable lift mechanism 43 for changing the lift amount of the intake valves 38 is rotationally driven by the actuator 60 which has the electric motor 62 and is mounted to the outer surface of the cylinder head 26, and when the electric motor 62 is not energized, the control shaft 54 is biased to rotate to the position where the lift amount of the intake valves 38 is the predetermined lift amount determined by the default mechanism 64 including the first and second default springs 94 and 95. The main part including at least one of both the default springs 94 and 95 of the default mechanism 64, the main part including the second default spring 95 in this embodiment, is placed inside the casing 61 of the actuator 60, and therefore the default mechanism 64 is placed inside the cylinder head 26, thereby preventing the cylinder head 26 from becoming large.

The default mechanism 64 includes the large diameter gear 92 which is moved with and connected to the electric motor 62 to rotate in the rotational range of less than one rotation in accordance with the rotation of the electric motor 62 in the range of the change in the lift amount of the intake valves 38, the spring holder 93 which abuts on and engages with the large diameter gear 92 to rotate around the same axis when the lift amount of the intake valves 38 is changed between the predetermined lift amount and the minimum lift amount, and has the rotational range restricted to between the predetermined lift amount and the minimum lift amount, the first default spring 94 which biases the large diameter gear 92 in the direction to abut on and engage with the spring holder 93, and the second default spring 95 which biases the spring holder 93 to the predetermined lift amount side from the minimum lift amount side, and has the spring load set to be larger than the first default spring 94, and at least the large diameter gear 92, the spring holder 93 and the second default spring 95 are placed in the casing 61 of the actuator 60. Therefore, the lift amount of the intake valves 38 can be reliably kept at the predetermined lift amount when the electric motor 62 is not energized, by use of the existing default mechanism which is adopted in the throttle valve or the like;

and by placing the second default spring 95 in the casing 62, an increase in the spring load of the second default spring 95 as a result of considering the speed reduction ratio, the speed reduction efficiency and the like in the actuator 60 is suppressed to be small, an increase in size of the second default spring 95 is avoided, and an increase in size of the casing 61 can be also avoided.

Because the large diameter gear 92 is moved with and connected to the worm wheel 65 which is fixed to the connecting shaft part 54*d* of the control shaft 54, and the worm gear 66 connected to the electric motor 62 via the deceleration mechanism 67 is meshed with the worm wheel 65, the load is transmitted from the second default spring 95 to the control shaft 54 on the transmission route in the same direction as the power transmission route from the worm gear 66 to the worm wheel 65 when rotationally driving the control shaft 54 by the operation of the electric motor 62, whereby reliable rotation of the control shaft 54 can be ensured at the time of default.

Because the first default spring 94 also has the function of absorbing a backlash between the worm wheel 65 and the worm gear 66, and is interposed between the control shaft 54 and the cylinder head 26, a spring exclusively for absorbing backlash between the worm gear 66 and the worm wheel 65 is not required, thereby reducing the number of components.

Because the actuator 60 is constructed to have an oilless structure without oil supply, a change in friction is not caused even if the ambient temperature changes, whereby the control shaft 54 can be always stably and rotationally driven. Because the oil seal is not required, the driving efficiency of the electric motor 62 is improved, and the default operation is smoothly performed at the time of fail-safe.

At least one of the gears which construct a part of the actuator 60 and are in pairs to be meshed with each other: in this embodiment, the worm wheel 65 of the worm wheel 65 and the worm gear 66, the driven gear 73 of the driving gear 72 and the driven gear 73, and the large diameter gear 92 of the large diameter gear 92 and the small diameter gear 97, are formed of a synthetic resin. Therefore, durability and quietness can be secured while the oilless structure is made possible.

Because the casing 61 of the actuator 60 and the cylinder head 26 are fitted to each other, and the casing 61 is fastened to the cylinder head 26 at the four spots in the periphery of the electric motor 62, the positioning accuracy of the casing 61 with respect to the cylinder head 26 is improved, and the periphery of the electric motor 62 which is a vibration generating source in the actuator 60 is fixed to the cylinder head 26, to thereby suppress vibrations exerted from the cylinder head 26 side to the actuator 60 side, and suppress the vibration caused by the operation of the electric motor 62. Thus, durability and quietness can be further improved.

A second embodiment of the present invention will be described with reference to FIGS. 9 to 18. In the second embodiment, the components corresponding to those in the first embodiment in FIGS. 1 to 8 are only illustrated while giving them the same reference numerals and symbols, and the detailed description of them will be omitted.

Figure 9:
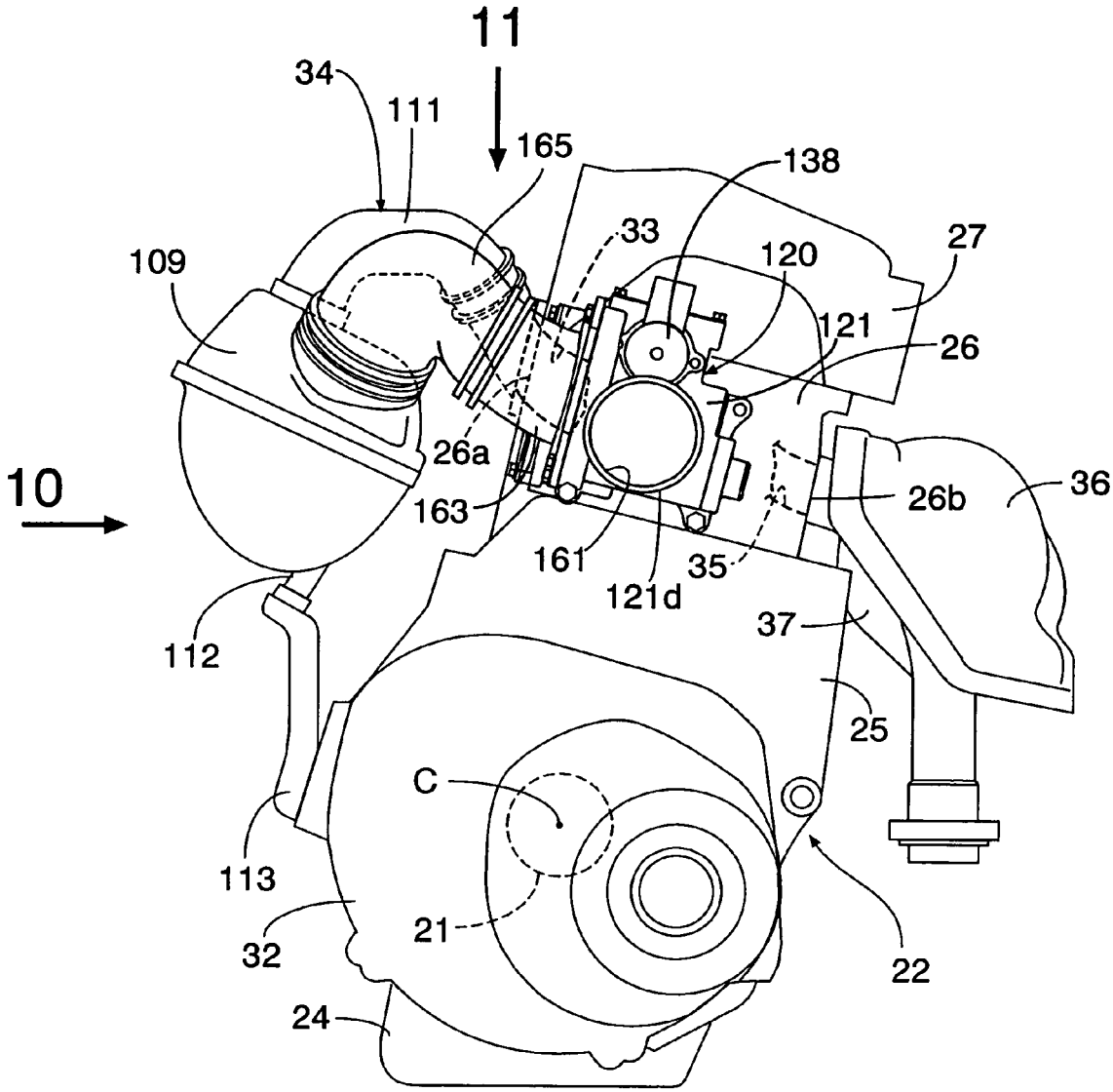
FIGS. 9 to 18 show a second embodiment of the present invention.
Figure 10:
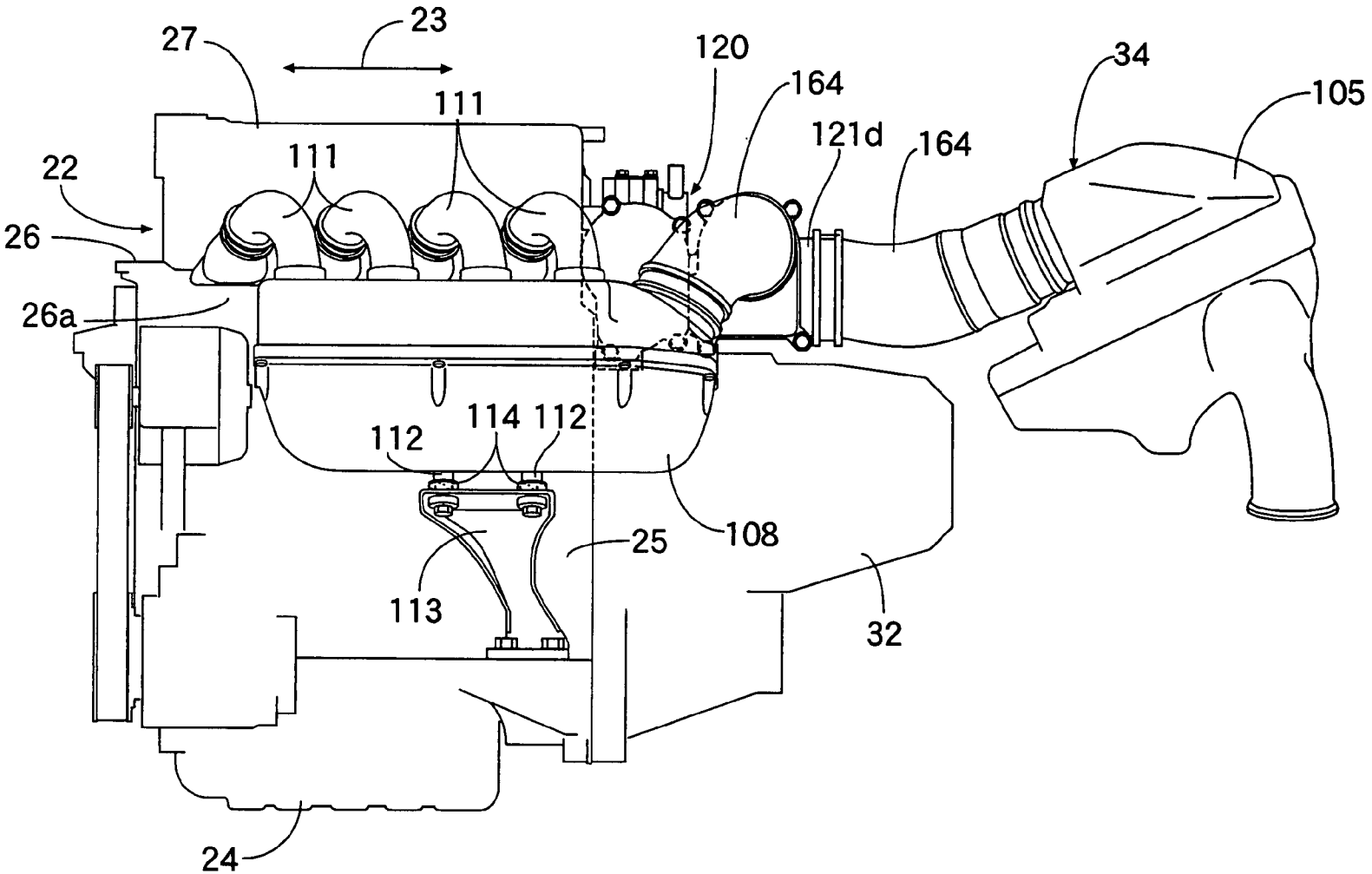
Figure 11:
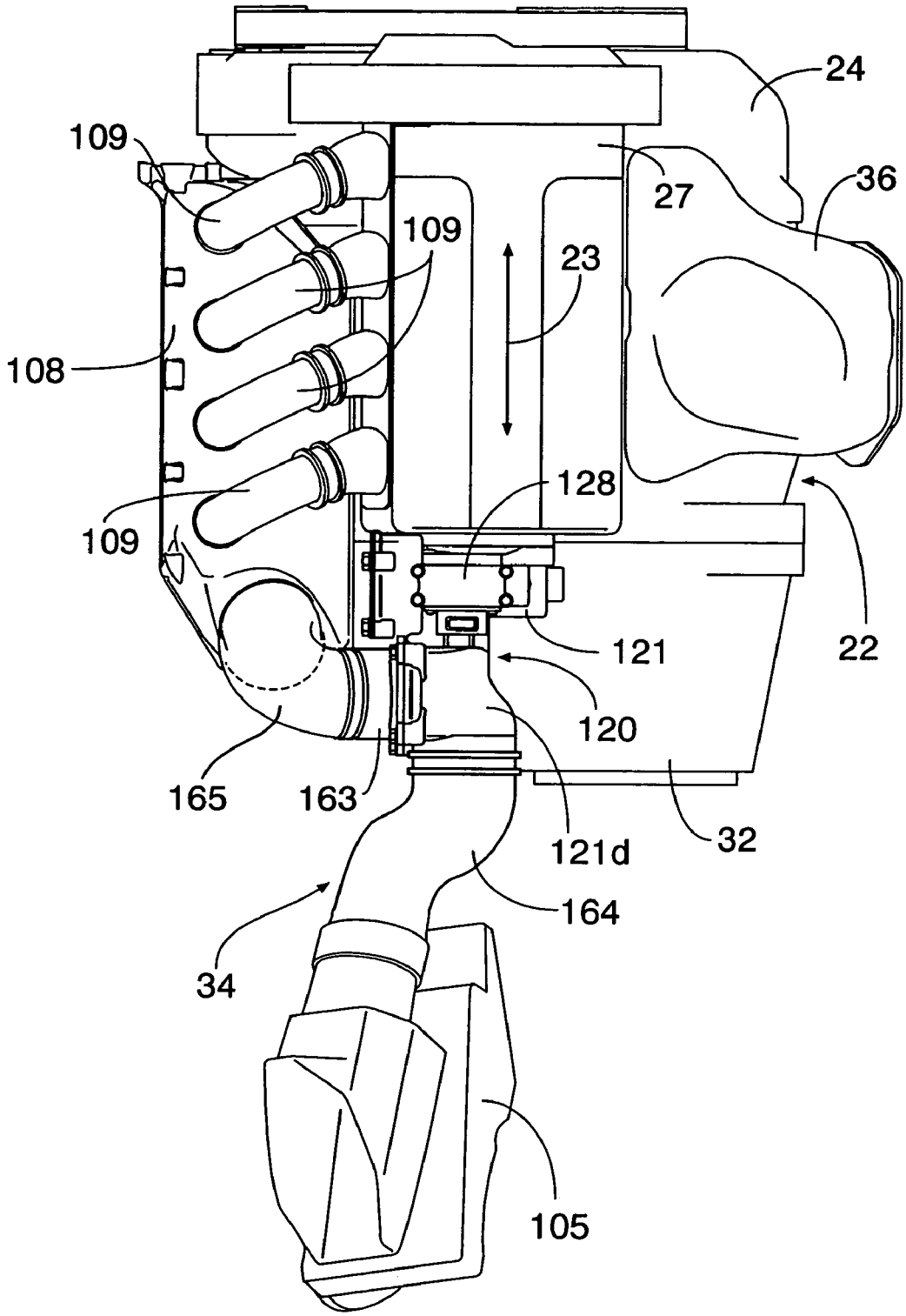
Figure 12:
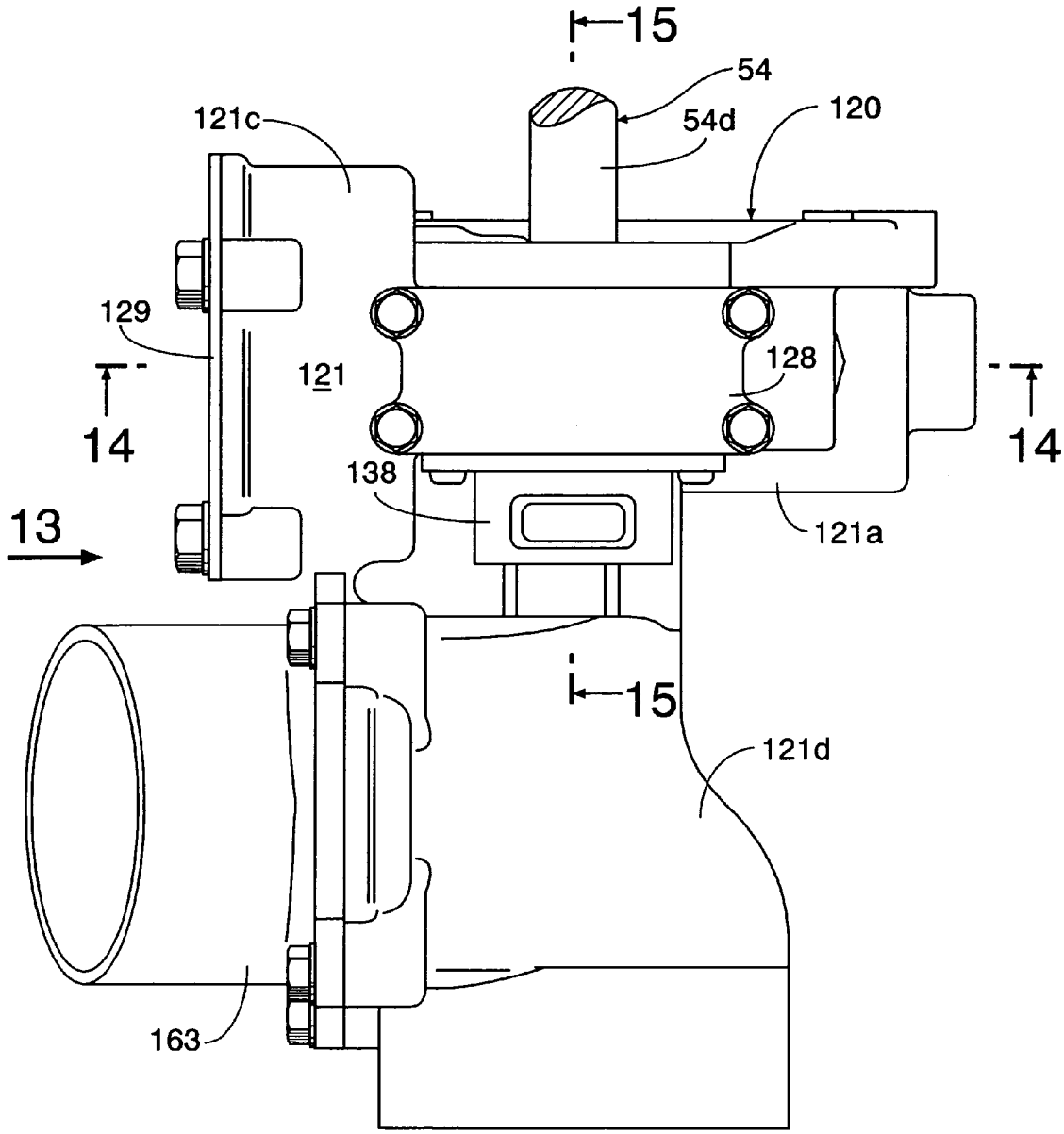
Figure 13:
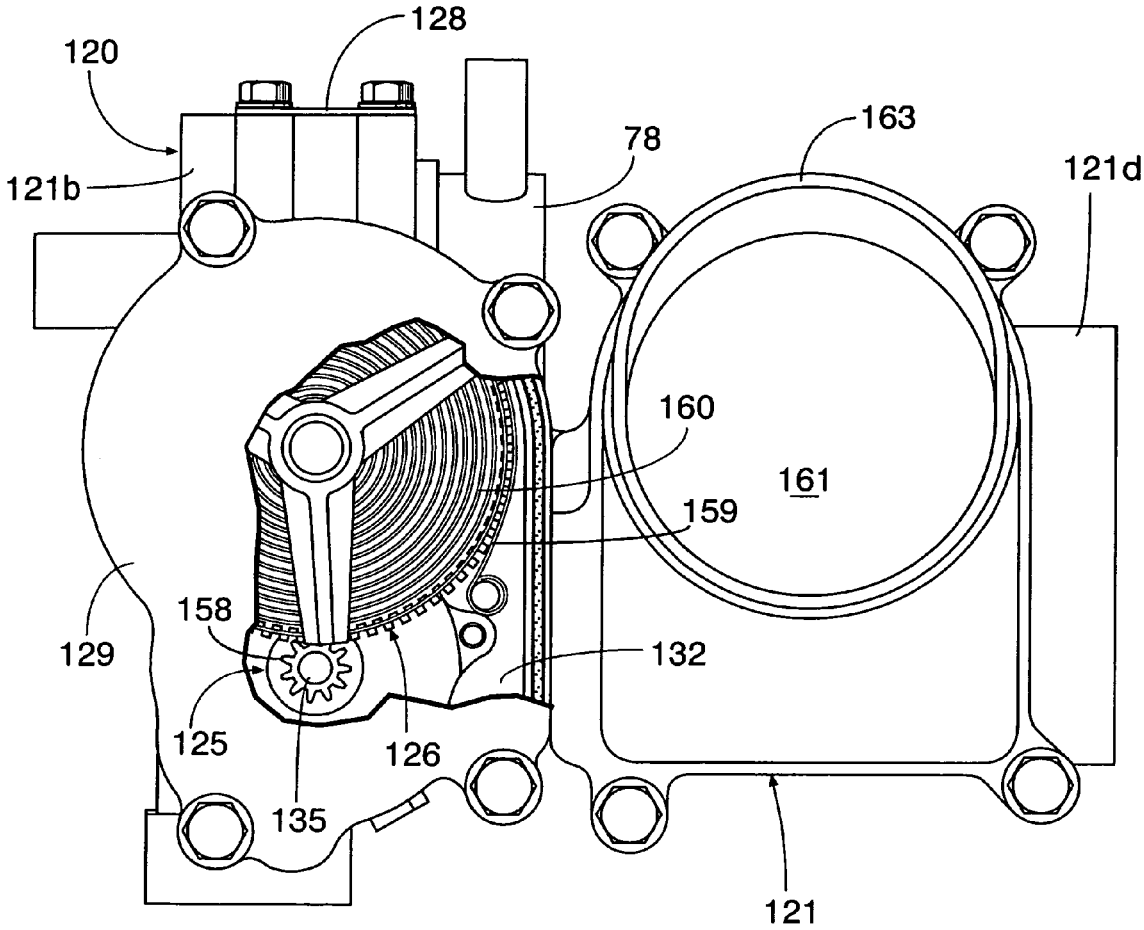

First, in FIGS. 9 to 11, the control shaft 54 of the variable lift mechanism 43 protrudes into a casing 121 of an actuator 120 which is mounted to an outer surface of a left side end wall of the cylinder head 26.

Referring to FIGS. 12 to 15 together, the actuator 120 includes an electric motor 122 which is a power source, power transmission means 119 which is provided between the electric motor 122 and the connecting shaft part 54*d* of the control shaft 54, and a default mechanism 126 for maintaining the connecting shaft part 54*d*, namely the control shaft 54, in a predetermined rotational position when the electric motor 122 is not energized, and a casing 121 having an oilless structure without oil supply and accommodating these members 122, 119 and 126.

The power transmission means 119 includes a worm wheel 123 which is fixed to the connecting shaft part 54*d* of the control shaft 54, a worm gear 124 which is meshed with the worm wheel 123, and a deceleration mechanism 125 which is provided between the worm gear 124 and the electric motor 122.

The electric motor 122 is capable of forward and reverse rotation from the position of a zero point corresponding to the default position determined by the default mechanism 126, and the actuator 120 is connected to the connecting shaft part 54*d* of the control shaft 54 so as to make the lift amount of the intake valve (see the first embodiment) larger than a predetermined amount at the time of the operation of a predetermined amount or more.

The casing 121 integrally includes a first accommodation part 121*a* which is formed into a bottomed cylindrical shape to form a motor accommodation chamber 130 circular in cross section extending in a lateral direction, a second accommodation part 121*b* which forms a first operation chamber 131 having a substantially U-shaped cross sectional shape with the cylinder head 26 side opened and which extends upward from the first accommodation part 121*a*, and a cylindrical third accommodation part 121*c* which forms a second operation chamber 132 adjacently disposed on sides of the first and second accommodation parts 121*a* and 121*b* and which extends to the side opposite from the first and second accommodation parts 121*a* and 121*b*. The casing 121 is fastened to the cylinder head 26.

An opening at one end of the motor accommodation chamber 130 communicates with a lower part of the second operation chamber 132, and a through-hole 133 which provides a connection between the lower portion of the first operation chamber 131 and the second operation chamber 132 is provided in a lower side wall of the second accommodation part 121*b* so as to have an axis that extends parallel with the motor accommodation chamber 130.

The opening on the cylinder head 26 side of the second accommodation part 121*b* is closed by the cylinder head 26 in the state in which the casing 121 is mounted to the cylinder head 26. An opening 134 which is provided at an upper end of the second accommodation part 121*b* is closed by a first lid plate 128 which is fastened to the upper end of the second accommodation part 121*b*. An open end of the third accommodation part 121*c* on the side opposite from the first and second accommodation parts 121*a* and 121*b* is closed by a second lid plate 129 which is fastened to the third accommodation part 121*c*.

The electric motor 122 is inserted in and fixed to the motor accommodation chamber 130, and an output shaft 135 of the electric motor 122 protrudes to the second operation chamber 132 side. The connecting shaft part 54*d* of the control shaft 54 protrudes into the first operation chamber 131, and the worm wheel 123 and the worm gear 124 are accommodated therein. The worm wheel 123 is fastened and fixed to the connecting shaft part 54*d* with a bolt 137 which is screwed into a screw hole 136 (see FIG. 9) coaxially provided at the end portion of the connecting shaft part 54*d*.

A sensor-receiving circular opening 139 for receiving a position sensor 138 which is mounted to the second accommodation part 121*b* is provided at a side wall of the second accommodation part 121*b* at a portion opposed to the worm wheel 123. The worm wheel 123 is provided with a pair of detection holes 140 and 140 in which the position sensor 138 is engaged.

Figure 16:
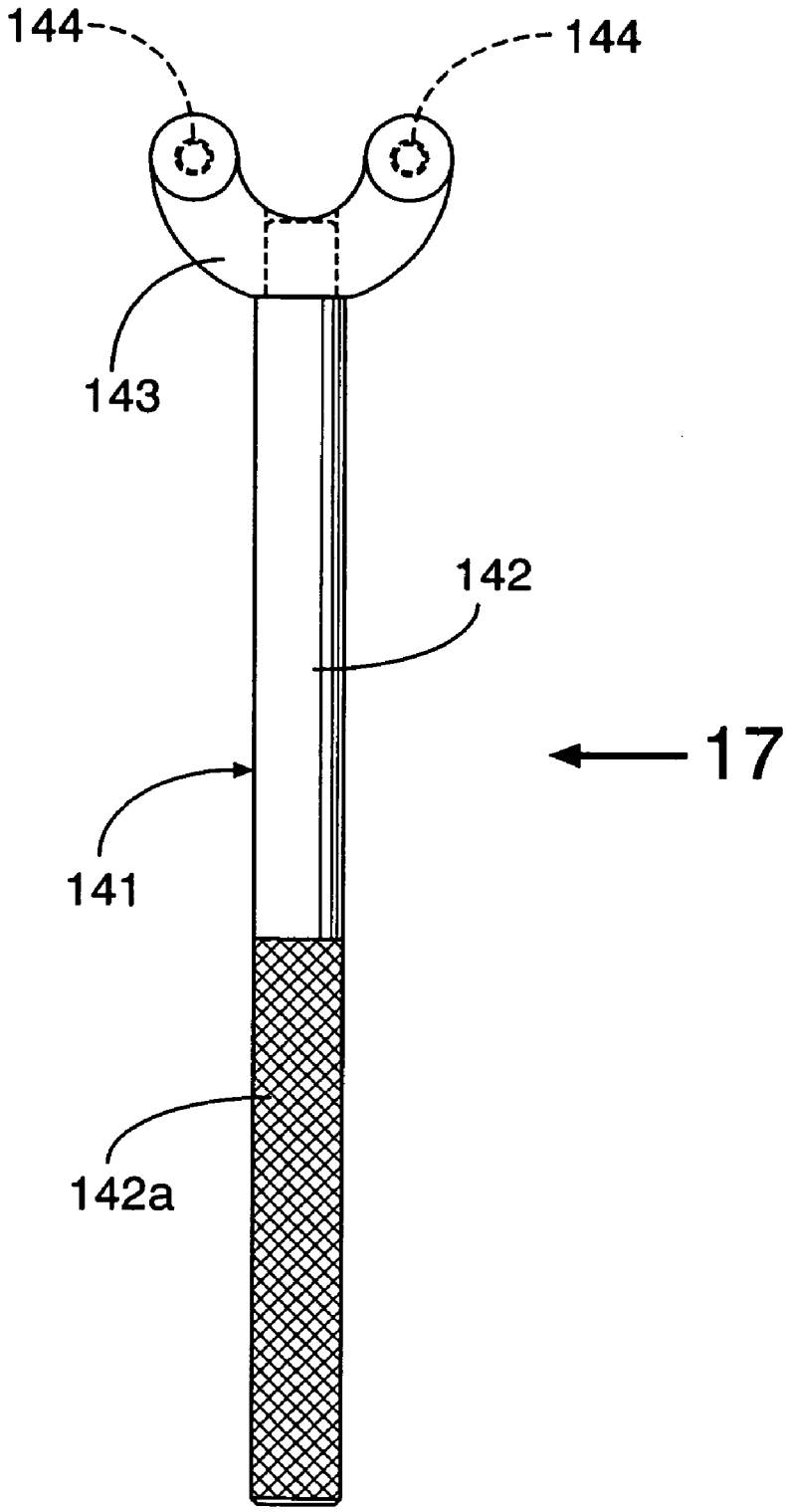
Figure 17:
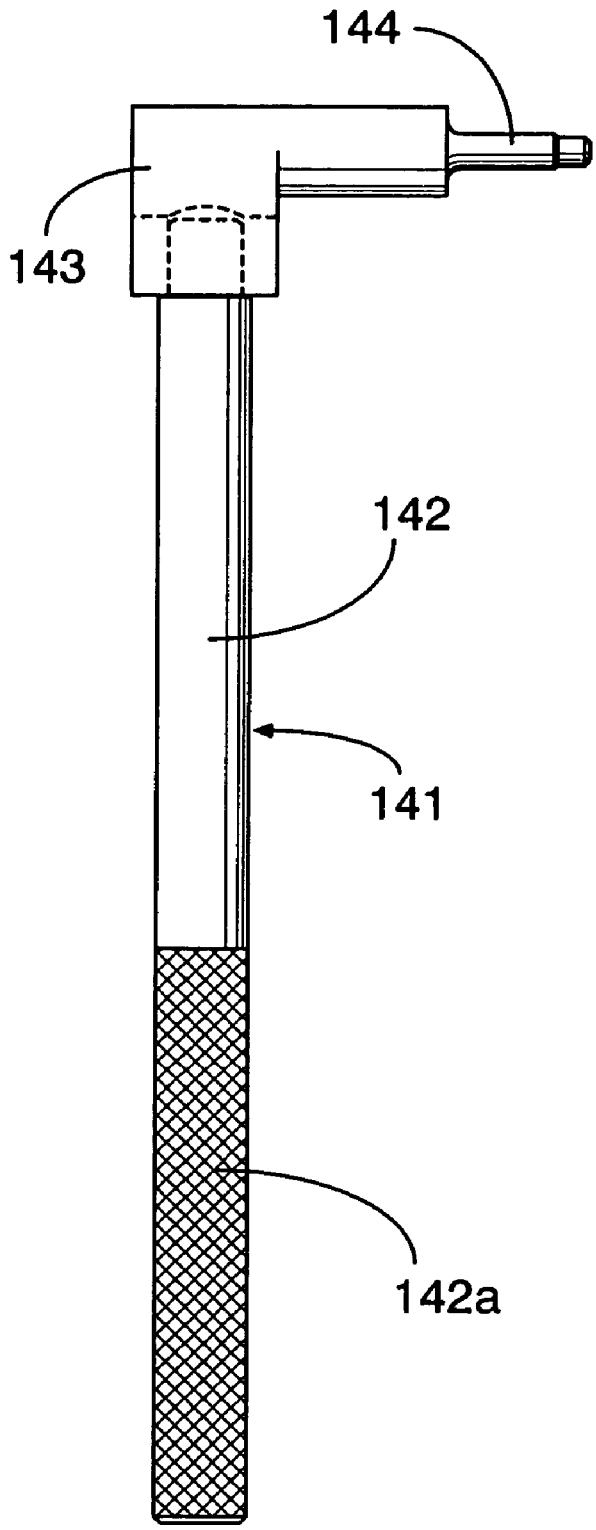

A jig 141 shown in FIGS. 16 and 17 is used when the worm wheel 123 is fastened to the connecting shaft part 54*d*. The jig 141 includes an operation shaft 142 having a grip portion 142*a* at one end side, a support arm 143 which is formed into a semicircle in a plane including the axis of the operation shaft 142 and is connected to the other end of the operation shaft 142, and a pair of engaging shafts 144 and 144 which are provided to protrude perpendicularly from opposite ends of the support arm 143. The worm wheel 123 is provided with engaging holes 145 and 145 in which both the engaging shafts 144 are engaged to be capable of being disengaged.

Figure 18:
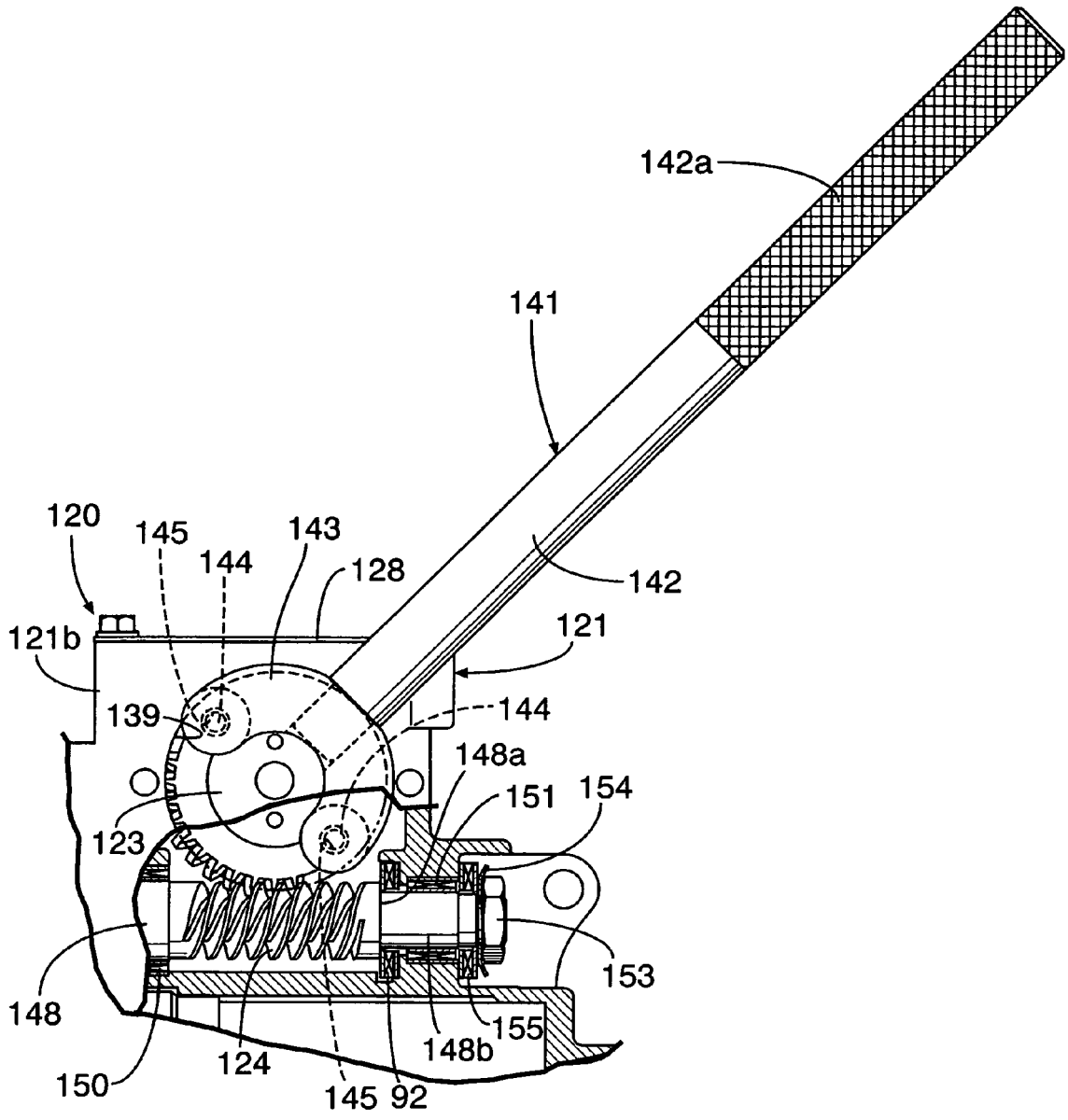

Thus, when the worm wheel 123 is fastened to the connecting shaft part 54*d*, the jig 141 is inserted into the first operation chamber 131 from the sensor-receiving opening 139 with the position sensor 138 removed therefrom, and while the rotation of the worm wheel 123 is inhibited by engaging the engaging shafts 144 of the jig 141 in the engaging holes 145 of the worm wheel 123, the fastening operation of the bolt 137 is performed from the sensor-receiving opening 139, as shown in FIG. 18.

Figure 14:
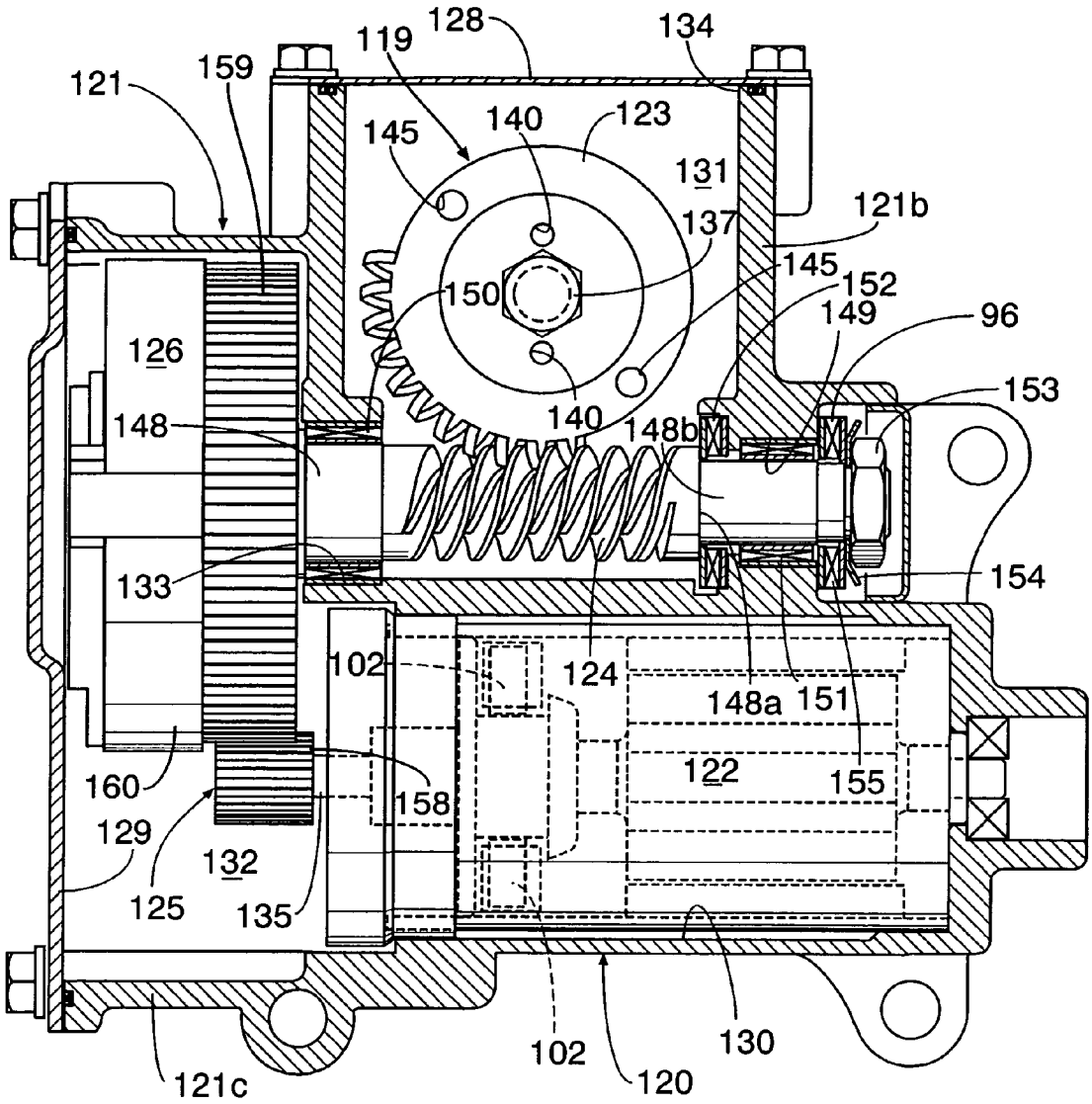
Figure 15:
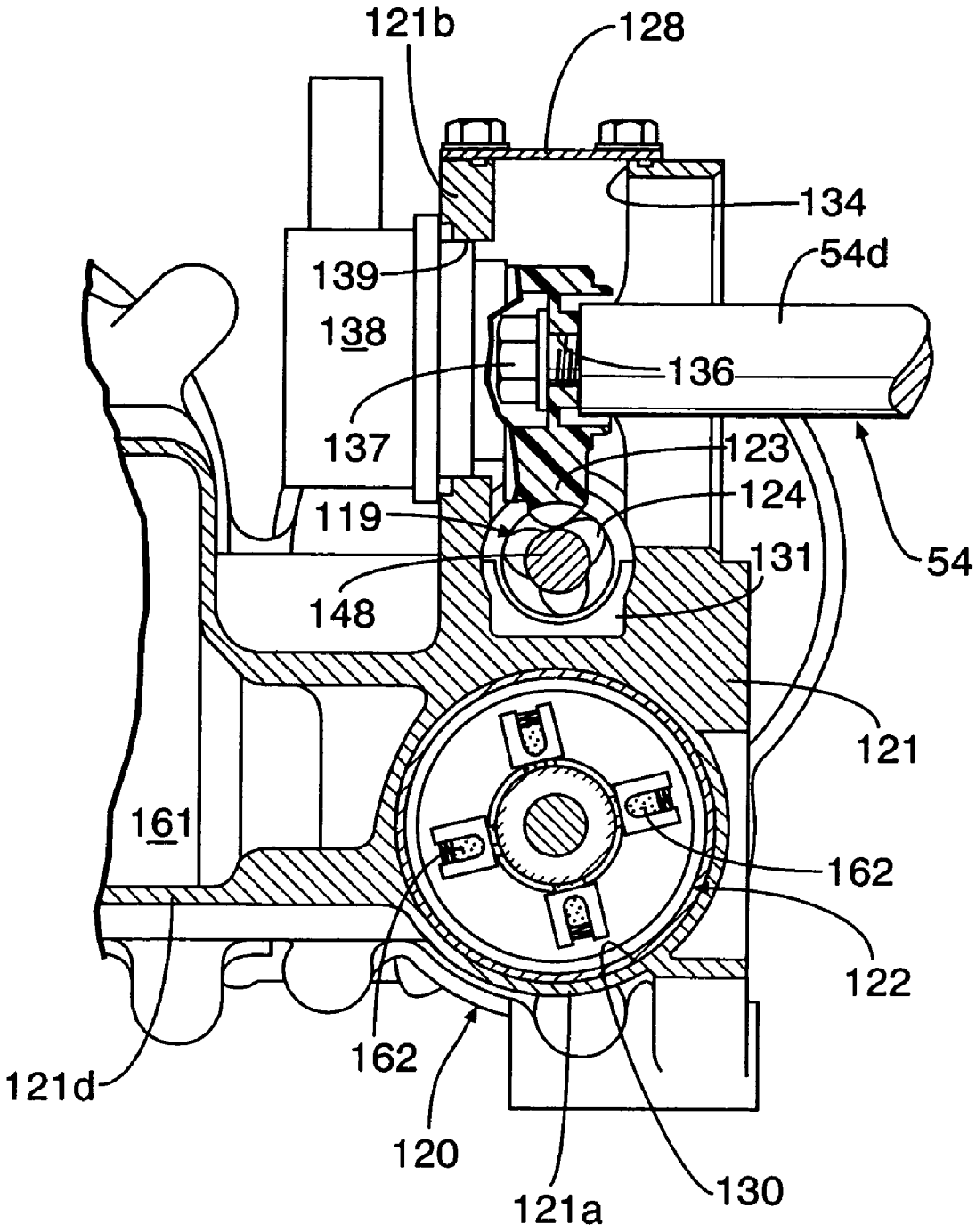

Paying attention to FIG. 14, the worm gear 124 is integrally provided on a worm gear shaft 148 which is disposed below the worm wheel 123 with its axis disposed in a plane orthogonal to the axis of the connecting shaft part 54*d*. One end of the worm gear shaft 148 rotatably penetrates through the through-hole 133, and the other end of the worm gear shaft 148 rotatably penetrates through a support hole 149 which is provided in a lower side wall of the second accommodation part 121*b*.

A needle bearing 150 is interposed between an outer periphery at one end side of the worm gear shaft 148 and an inner periphery of the through-hole 133. A small diameter shaft part 148*b* is coaxially and integrally provided at the other end side of the worm gear shaft 148 so as to form an annular step part 148*a* facing a side opposite from the worm gear 124. A needle bearing 151 is interposed between an outer periphery of the small diameter shaft part 148*b* and an inner periphery of the support hole 149.

A thrust bearing 152 is interposed between the step part 148*a* of the worm gear shaft 148 and an inner surface of the second accommodation part 121*b*. A male screw (not shown) is provided by engraving in an outer periphery of a tip end of the small diameter shaft part 148*b*, and a thrust bearing 155 is interposed between a washer 154 which is engaged with a lock nut 153 screwed onto the male screw and an outer surface of the second accommodation part 121*b*. Namely, a pair of thrust bearings 152 and 155 are interposed between the casing 121 and the worm gear shaft 148, in addition to a pair of needle bearings 150 and 151.

The deceleration mechanism 125 is constructed by a small diameter driving gear 158 which is fixed to the output shaft 135 of the electric motor 122, and a large diameter driven gear 159 which is fixed to one end of the worm gear shaft 148, and is accommodated in the second operation chamber 132. The default mechanism 126 has a spiral spring 160 which is connected to the driven gear 159, and when the electric motor 122 is not energized, the spiral spring 160 exerts a spring force that rotates the worm wheel 123 and the connecting shaft part 54*d* by a predetermined angle against the spring force of the spiral spring 97, whereby the lift amount of the intake valves 38 is kept to be a predetermined amount.

Incidentally, at least one of the gears which construct a part of the actuator 120 and are in pairs to be meshed with each other, namely, at least one of the worm wheel 123 and the worm gear 124, and one of the driving gear 158 and the driven gear 159, are formed of a synthetic resin.

Incidentally, the casing 121 integrally has a cylindrical passage forming part 121*d* in addition to the first to third accommodation parts 121*a*, 121*b* and 121*c*, and this passage forming part 121*d* is formed into a cylindrical shape extending to the side opposite from the cylinder head 26 from the first accommodation part 121*a* which forms the motor accommodation chamber 130 which accommodates the electric motor 122.

Thus, the passage forming part 121*d* forms an intake passage 161 which constructs a part of the intake system 34 which is connected to the cylinder head 26, and the intake passage 161 is formed so as to sandwich the first accommodation part 121*a* of the casing 121 between the intake passage 161 and the portions corresponding to the brushes 162 of the electric motor 122, in the structure of the electric motor 122 accommodated by the motor accommodation chamber 130. Namely, a part of a sidewall of the first accommodation part 121*a* of the casing 121 is disposed to face the intake passage 161; and the potions, corresponding to the brushes 162, of the electric motor 122 are disposed inward of the portion, facing the intake passage 161, of the first accommodation part 121*a* of the casing 121. The thickness of the region, facing the intake passage 161, of the casing 121, namely a part of the side wall of the first accommodation part 121*a* is formed to be thinner than the other region of the casing 121.

The passage forming part 121*d* is formed so that intake air flows substantially orthogonally to the side wall of the first accommodation part 121*a* that is a part of the casing 121 which faces the intake passage 161, and a passage member 163 is fastened to an intermediate portion of the passage forming part 121*d* to lead orthogonally to an intermediate portion of the intake passage 161.

Again in FIGS. 10 to 11, an air cleaner 105 of the intake system 34 is connected to the passage forming part 121*d* of the actuator 120 via a pipeline member 164 such as a hose, and the passage member 163 which is fastened to the passage forming part 121*d* is connected to the intake chamber 108 via the pipeline member 165 such as the hose.

According to the second embodiment, since the actuator 120 is constructed to have an oilless structure without oil supply, change in friction is not caused even if the ambient temperature changes, and the control shaft 54 can be always stably and rotationally driven. An oil seal is not required, whereby driving efficiency of the electric motor 122 is improved, and the default operation is made smooth at the time of fail-safe.

Because a part of the casing 121 of the actuator 120 is disposed to face the intake passage 161 which constructs a part of the intake system 34 connected to the cylinder head 26, the casing 121 is cooled by air which flows through the intake passage 161. Therefore, the actuator 120 can be effectively cooled, while eliminating the need of an electric motor or the like exclusively for cooling the actuator 120 to avoid increase in the number of components.

The actuator 120 is connected to the variable lift mechanism so that the lift amount of the intake valve is made larger than a predetermined amount corresponding to the operation amount of the actuator 120 becoming larger than the predetermined amount, and when the operation amount of the actuator 120 becomes larger than the predetermined amount, the intake air flow rate becomes larger, thereby effectively cooling the actuator 120.

Because the thickness of the casing 121 at the region facing the intake passage 161 is formed to be thinner than that of the other regions, the thermal gradient becomes large in the portion facing the intake passage 161 of the casing 121, thereby improving the cooling effect, and further the passage forming part 121*d*which is integrally included by the casing 121 to form the intake passage 161 is formed so that the intake air flows substantially perpendicularly to a part of the casing 121 facing the intake passage 161, whereby the thermal gradient in the portion facing the intake passage 161 of the casing 121 is also made large to improve the cooling effect.

Because the electric motor 122 is disposed inward of the portion, facing the intake passage 161, of the casing 121, the electric motor 122, which is a heat generating source, of the actuator 120 can be more effectively cooled, and the portion, corresponding to the brushes 162, of the electric motor 122 is disposed inward of the portion facing the intake passage 161, of the casing 121. Therefore, the heat generating portion of the electric motor 122 can be effectively cooled.

The actuator 120 includes the electric motor 122, the worm wheel 123 fixed to the connecting shaft part 54*d* included by the control shaft 54, the worm gear 124 which is meshed with the worm wheel 123, and the deceleration mechanism 125 provided between the worm gear 124 and the electric motor 122. The actuator 120 can be made compact as compared with a lever type actuator which is constructed to rotationally drive the control shaft 54 by using a lever.

Because the thrust bearings 152 and 155 are interposed between the worm gear shaft 148 provided with the worm gear 124 and the casing 121 of the actuator 120, in addition to the needle bearings 150 and 151, a thrust force which acts on the worm gear shaft 148 by meshing between the worm wheel 123 and the worm gear 124 is received by the thrust bearings 152 and 155, thereby suppressing rattling of the work gear shaft 148 and extending the life of the needle bearings 150 and 151.

The worm wheel 123 is fastened to the connecting shaft part 54*d* of the control shaft 124 with the coaxial bolt 137, and the worm wheel 123 is provided with a pair of engaging holes 145 in which the jig 141 is inserted and disengageably engaged so as to inhibit the worm wheel 123 from rotating around the axis of the connecting shaft part 54*d* when fastened to the connecting shaft part 54*d*, and when the worm wheel 123 is fastened and fixed to the connecting shaft part 54*d* of the control shaft 54 with the worm wheel 123 meshed with the worm gear 124, fastening torque is prevented from acting on the meshing teeth surfaces of the worm wheel 123 and the worm gear 124, whereby damage does not occur to the teeth surfaces.

The embodiments of the present invention are described thus far, but the present invention is not limited to the above described embodiments, and various design changes can be made without departing from the present invention described in claims.

What is claimed is:

1. A variable lift valve operating system for an internal combustion engine, comprising:

a variable lift mechanism which includes a control shaft rotatably supported in a cylinder head to change a lift amount of an engine valve in accordance with rotation of the control shaft; and an actuator which is connected to the control shaft and which comprises an electric motor and a power transmission that is interposed between the electric motor and the control shaft, wherein the power transmission comprises a worm wheel, a worm gear in mesh with the worm wheel, and a deceleration mechanism disposed between the worm gear and the electric motor, and a default spring coupled to an end of the worm gear;

wherein the worm wheel which is in mesh with the worm gear is connected to the control shaft;

wherein the actuator is constructed to be an oilless structure without oil supply; and wherein at least one of gears which constitute a part of the actuator and which are in a pair to be meshed with each other is formed of a synthetic resin.

2. The variable lift valve operating system for an internal combustion engine according to claim 1, wherein a casing of the actuator and the cylinder head are fitted to each other; and wherein the casing is fastened to the cylinder head at four spots on a periphery of the electric motor.

3. The variable lift valve operating system for an internal combustion engine according to claim 1, wherein a casing of the actuator and the cylinder head are fitted to each other; and wherein the casing is fastened to the cylinder head at four spots on a periphery of the electric motor.

4. The variable lift valve operating system for an internal combustion engine according to claim 1, wherein the power transmission is free from oil.

5. The variable lift valve operating system for an internal combustion engine according to claim 1, wherein the electric motor is free from oil.

6. The variable lift valve operating system for an internal combustion engine according to claim 5, wherein both the electric motor and the power transmission are free from oil.

7. The variable lift valve operating system for an internal combustion engine according to claim 1, wherein there is no oil seal in the electric motor.

8. A variable lift valve operating system for an internal combustion engine, comprising:

a variable lift mechanism which includes a control shaft rotatably supported in a cylinder head to change a lift amount of an engine valve in accordance with rotation of the control shaft; and an actuator which is connected to the control shaft and which comprises an electric motor and a power transmission that is interposed between the electric motor and the control shaft, wherein the power transmission comprises a worm wheel, a worm gear in mesh with the worm wheel, and a deceleration mechanism disposed between the worm gear and the electric motor, and a default spring coupled to an end of the worm gear;

wherein the control shaft is fixed with and surrounded by a inside the cylinder head, and a helical torsion coil spring wound around the spring holder, wherein one end of the spring is engaged with the cylinder head and the other end is engaged with the spring holder;

wherein the actuator is constructed to be an oilless structure without oil supply; and wherein at least one of gears which constitute a part of the actuator and which are in a pair to be meshed with each other is formed of a synthetic resin.

9. The variable lift valve operating system for an internal combustion engine according to claim 8, comprising a default second spring inside a housing of the actuator.

10. A variable lift valve operating system for an internal combustion engine, comprising:

a variable lift mechanism which includes a control shaft rotatably supported in a cylinder head to change a lift amount of an engine valve in accordance with rotation of the control shaft; and an actuator which is connected to the control shaft and which comprises an electric motor and a power transmission that is interposed between the electric motor and the control shaft;

wherein the power transmission comprises a worm wheel, a worm gear in mesh with the worm wheel, and a deceleration mechanism disposed between the worm gear and the electric motor, and a default spring coupled to an end of the worm gear;

wherein the worm wheel which is in mesh wit the worm gear is connected to the control shaft; and wherein the actuator is constructed to be an oilless structure without oil supply.

11. A variable lift valve operating system for an internal combustion engine, comprising:

a variable lift mechanism which includes a control shaft rotatably supported in a cylinder head to change a lift amount of an engine valve in accordance with rotation of the control shaft; and an actuator which is connected to the control shaft and which comprises an electric motor and a power transmission that is interposed between the electric motor and the control shaft;

wherein the power transmission comprises a worm wheel, a worm gear in mesh with the worm wheel, and a deceleration mechanism disposed between the worm gear and the electric motor, and a default spring coupled to an end of the worm gear;

wherein the control shaft is fixed with and surrounded by a inside the cylinder head, and a helical torsion coil spring wound around the spring holder, wherein one end of the spring is engaged with the cylinder head and the other end is engaged with the spring holder; and wherein the actuator is constructed to be an oilless structure without oil supply.

* * * * *